US006540134B1

(12) United States Patent
Rasche

(10) Patent No.: US 6,540,134 B1
(45) Date of Patent: Apr. 1, 2003

(54) PARCEL BOX

(76) Inventor: Joseph A. Rasche, 2124 N. Hannah Ct., Lebanon, IN (US) 46052

( * ) Notice: Subject to any disclaimer, the term of this patent is extended or adjusted under 35 U.S.C. 154(b) by 24 days.

(21) Appl. No.: 09/691,328

(22) Filed: Oct. 18, 2000

Related U.S. Application Data

(60) Provisional application No. 60/160,223, filed on Oct. 18, 1999, and provisional application No. 60/196,025, filed on Apr. 7, 2000.

(51) Int. Cl.[7] ..... B65D 91/00
(52) U.S. Cl. ..... 232/17; 220/4.28
(58) Field of Search ..... 232/17, 45; 220/4.28, 220/4.29, 6, 8

(56) References Cited

U.S. PATENT DOCUMENTS

| | | | | | |
|---|---|---|---|---|---|
| 489,711 | A | * | 1/1893 | Mandioni | 220/6 |
| 1,194,570 | A | * | 8/1916 | Stuart | 220/6 |
| 1,198,524 | A | * | 9/1916 | Cunliffe | 220/6 |
| 1,282,117 | A | * | 10/1918 | Ollom et al. | 220/6 |
| 1,443,901 | A | * | 1/1923 | Murray | 220/6 |
| 1,451,468 | A | * | 4/1923 | Olshan | 220/6 |
| 1,651,284 | A | * | 11/1927 | Leiberman | 220/6 |
| 2,221,504 | A | * | 11/1940 | Beasley et al. | 220/6 |
| 3,330,437 | A | * | 7/1967 | Bellamy | 220/62 |
| 3,611,994 | A | * | 10/1971 | Bailey et al. | 119/496 |
| 3,814,220 | A | * | 6/1974 | Brody | 190/19 |
| 4,235,346 | A | * | 11/1980 | Liggett | 220/7 |
| 4,724,999 | A | | 2/1988 | Fitzgerald et al. | |
| 4,905,891 | A | | 3/1990 | Wildish et al. | |
| 4,993,626 | A | | 2/1991 | Berry | |
| 5,038,998 | A | * | 8/1991 | Morris et al. | 206/509 |
| 5,056,711 | A | | 10/1991 | Bush | |
| 5,071,063 | A | | 12/1991 | Overstreet | |
| 5,096,115 | A | | 3/1992 | Hassan | |
| 5,143,284 | A | | 9/1992 | Socarras | |
| 5,351,883 | A | | 10/1994 | Pachi | |
| 5,390,849 | A | | 2/1995 | Frissard | |
| 5,400,960 | A | | 3/1995 | Jeffs | |
| 5,526,979 | A | | 6/1996 | Mann | |
| 5,564,624 | A | | 10/1996 | Davis, Jr. | |
| 5,664,727 | A | * | 9/1997 | Beall | 232/1 R |
| 5,664,729 | A | | 9/1997 | Ladewig | |
| 5,820,018 | A | | 10/1998 | Stacy | |
| 5,833,132 | A | | 11/1998 | Bachmeier | |
| 5,850,967 | A | | 12/1998 | White | |
| 5,938,113 | A | | 8/1999 | Kim | |
| 5,992,736 | A | | 11/1999 | Parker | |

* cited by examiner

*Primary Examiner*—William Miller
(74) *Attorney, Agent, or Firm*—Barnes & Thornburg

(57) ABSTRACT

An enclosure includes a pair of panel mounts for orienting adjacent a surface, a pair of side panels movably coupled to the panel mounts and movable between storage orientations generally between the panel mounts and use orientations in which they project away from the surface generally perpendicular thereto, a top panel having a storage orientation generally between the panel mounts and a use orientation in which it is projected from between the panel mounts and pivoted downwardly and forwardly to overlie and engage the side panels and a front panel for engagement with the side panels and the top panel when the top panel is in its use orientation to form an enclosure.

8 Claims, 44 Drawing Sheets

68
96
56
50
54
64
70
46
72
48
86
52
47
78
42
76
63

50
64
50
92
56
92
98
90
100
98
90

50
64
50
56
92
92
100
98
90
98
90

PARCEL BOX

This application claims the benefit of U.S. Ser. No. 60/160,223, filed Oct. 18, 1999 and U.S. Ser. No. 60/196,025, filed Apr. 7, 2000.

FIELD OF THE INVENTION

This invention relates to parcel handling. It is disclosed in the context of a secure box for the delivery of parcels to, for example, residential customers of parcel delivery services, but is believed to have applications in other fields as well.

BACKGROUND OF THE INVENTION

Due in part to the increasing popularity of Internet commerce, the need has developed for a system that would permit parcel addressees to receive parcels in a relatively more secure manner. There are the methods and apparatus described in the following U.S. Pat. Nos.: 4,724,999; 4,905,891; 4,993,626; 5,056,711; 5,071,063; 5,096,115; 5,143,284; 5,351,883; 5,390,849; 5,400,960; 5,526,979; 5,564,624; 5,664,729; 5,820,018; 5,833,132; 5,850,967; 5,938,113; and, 5,992,736. The disclosures of these prior art references are hereby incorporated by reference. This listing is not intended as a representation that a thorough search of the prior art has been conducted, or that no more pertinent art than that listed above exists, or that the cited art is, or is considered to be, material to patentability of the disclosed invention. Nor should any such representation be inferred.

SUMMARY OF THE INVENTION

An enclosure includes a pair of panel mounts for orienting adjacent a surface, a pair of side panels movably coupled to the panel mounts and movable between storage orientations generally between the panel mounts and use orientations in which they project away from the surface generally perpendicular thereto, a top panel having a storage orientation generally between the panel mounts and a use orientation in which it is projected from between the panel mounts and pivoted downwardly and forwardly to overlie and engage the side panels and a front panel for engagement with the side panels and the top panel when the top panel is in its use orientation to form an enclosure.

Illustratively according to this aspect of the invention, the side panels are pivotally coupled to the panel mounts by hinges.

Further illustratively according to this aspect of the invention, the enclosure includes links for coupling the side panels and the front panel together and to the panel mounts. Each side panel is pivotally coupled to a panel mount and projects forwardly therefrom in a use orientation and is pivotally coupled to a respective link. Each link is pivotally coupled to the front panel.

Additionally illustratively according to this aspect of the invention, the top panel has a use orientation in which it is projected upward from between the panel mounts and pivoted downwardly and forwardly to overlie and engage the side panels.

Illustratively according to this aspect of the invention, the front and top panels include a front panel, a first top component, and a second top component.

Further illustratively according to this aspect of the invention, the enclosure includes a mechanism by which the parcel receiving box can be locked when the panels are so oriented as to form an enclosure.

Further illustratively according to this aspect of the invention, the enclosure includes a bottom panel having a storage orientation in which it lies generally between the panel mounts and a use orientation in which it is pivoted forwardly and downwardly with respect to the panel mounts to lie at the bottom of the enclosure.

Further illustratively according to this aspect of the invention, the enclosure includes a device for limiting the forward and downward pivoting of the bottom panel with respect to the panel mount.

According to another aspect of the invention, a method for providing an enclosure includes providing a pair of panel mounts for orienting adjacent a surface, movably coupling a pair of side panels to the panel mounts for movement between storage orientations generally between the panel mounts and use orientations in which they project away from the surface generally perpendicular thereto, mounting a top panel for movement between a storage orientation generally between the panel mounts and a use orientation overlying and engaging the side panels, and providing a front panel for engaging the side panels and the top panel when the top panel is in its use orientation to form an enclosure.

Illustratively according to this aspect of the invention, pivotally coupling the side panels to the panel mounts includes hingedly coupling the side panels to the panel mounts.

Further illustratively according to this aspect of the invention, the method includes coupling the side panels and the front panel together through links. Each side panel is pivotally coupled to a panel mount and projects forwardly therefrom in a use orientation and is pivotally coupled to a respective link. Each link is pivotally coupled to the front panel.

Additionally illustratively according to this aspect of the invention, the method includes projecting the top panel upward from between the panel mounts and pivoting the top panel downwardly and forwardly to overlie and engage the side panels.

Illustratively according to this aspect of the invention, providing front and top panels includes providing a front panel, a first top component, and a second top component.

Further illustratively according to this aspect of the invention, the method includes providing a mechanism by which the parcel receiving box can be locked when the panels are so oriented as to form an enclosure.

Further illustratively according to this aspect of the invention, the method includes providing a bottom panel having a storage orientation in which it lies generally between the panel mounts and a use orientation in which it is pivoted forwardly and downwardly with respect to the panel mounts to lie at the bottom of the enclosure.

Further illustratively according to this aspect of the invention, the method includes limiting the forward and downward pivoting of the bottom panel with respect to the panel mount.

BRIEF DESCRIPTION OF THE DRAWINGS

The invention may best be understood by referring to the following detailed descriptions of illustrative embodiments and accompanying drawings. In the drawings.

DETAILED DESCRIPTION OF ILLUSTRATIVE EMBODIMENTS

Figure 1:
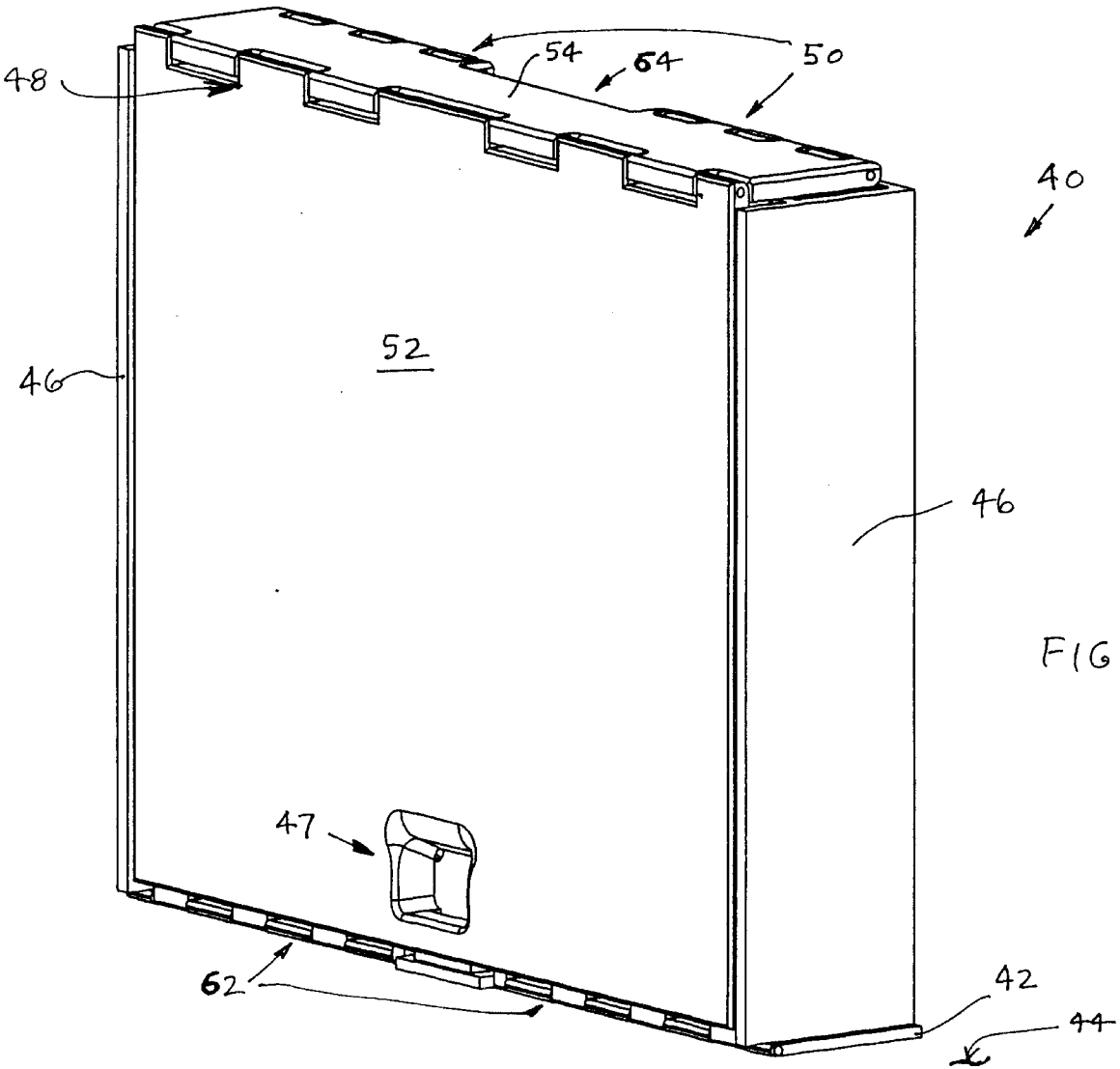
FIG. 1 illustrates a perspective view, taken from the front, right hand side and above, of an embodiment of the invention in the stored, or undeployed, orientation.

The fold-out parcel receiving box 40, hanging fold-out parcel receiving box 140 and the swing-out parcel receiving box 240 illustrated and described herein have been developed to meet this need. The parcel receiving boxes 40, 140, 240 illustrated and described herein fold away when not in use. Illustrative dimensions for the parcel receiving boxes 40, 140, 240 illustrated and described herein are 40 inches by 40 inches by 40 inches. However, it should be clear that the sizes of the various disclosed embodiments can be scaled to meet the needs of a particular application. Similarly, the illustrated embodiments contemplate blow molded resin construction, but any other suitable construction technique, such as stamped or otherwise formed metal construction, may be used to realize a fold-out parcel receiving box according to the invention.

FIG. 1 illustrates a front view of a first embodiment of a fold-out parcel receiving box 40 in its undeployed orientation. The parcel box 40 includes a mounting plate 42 which rests on a suitable surface 44, such as, for example, the floor of a porch of a residence, a concrete pad, or the ground. A pair of side wall mounts 46 are attached, such as by threaded fasteners or other suitable means, to, for example, a vertical outside wall of the residence or other structure. A mechanism 47 by which the parcel receiving box 40 is locked is not illustrated in detail, but may be any of a number of known types. Hinges 48, 50, respectively, are provided between a front door 52 and a small top lid 54, and between the small top lid 54 and a large top lid 56, FIG. 2. Suitable hinge pins of any sufficiently durable material, such as steel, pass through mating passageways in the hinge 48, 50 knuckles to complete the hinge joints. A hinge 62 between a "drawbridge" door 63 and the mounting plate 42 is also illustrated. A handle slot 64 by which the small top lid 54 is manipulated during the opening process of the fold out parcel receiving box 40 is also illustrated.

Figure 2:
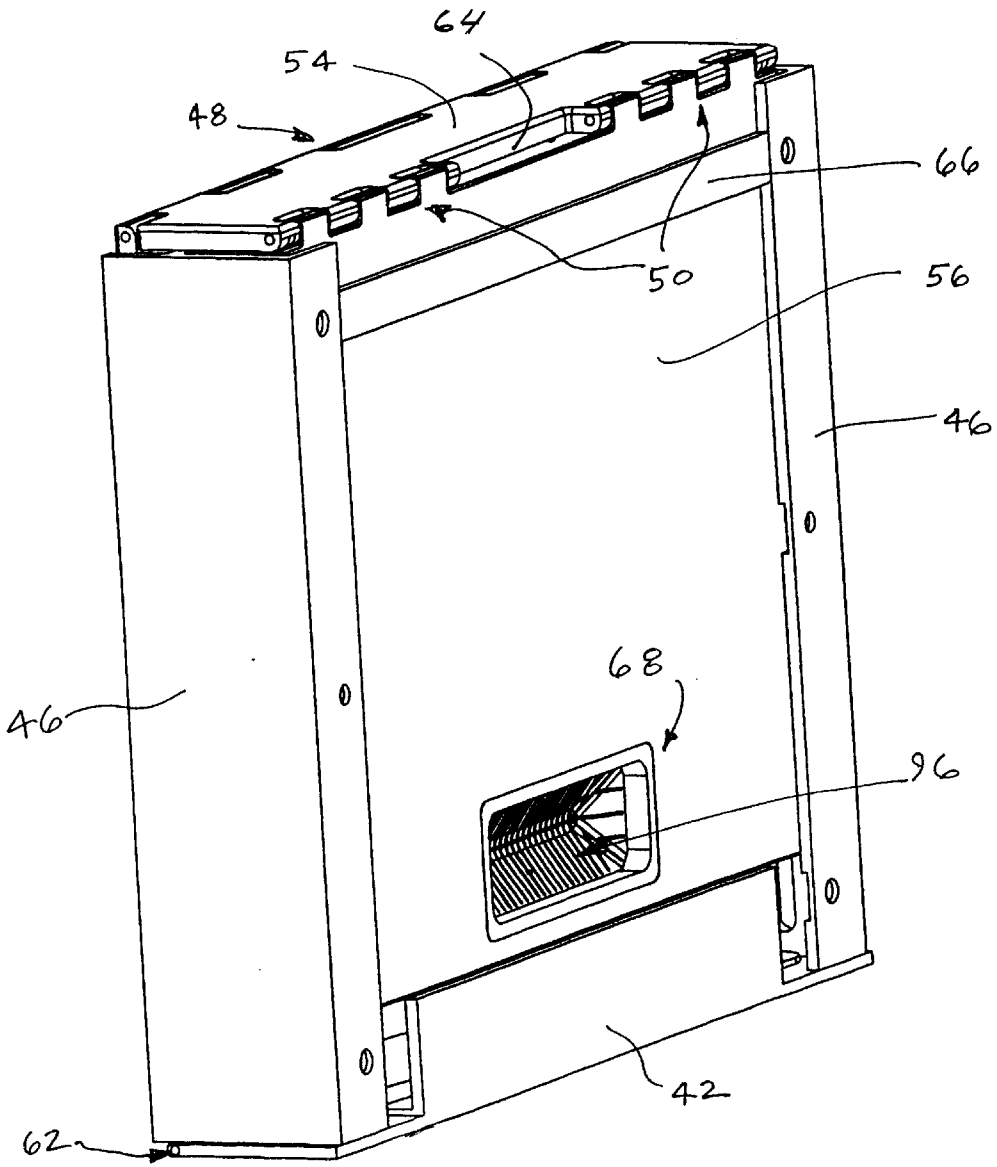
FIG. 2 illustrates a perspective view of the embodiment illustrated in FIG. 1, taken from the rear, right hand side and above.

FIG. 2 illustrates a back view of the fold-out parcel receiving box 40 illustrated in FIG. 1. A single bracing bar 66 is illustrated. (An) additional bracing bar(s) 66 can be added as believed necessary or advisable to increase sturdiness of the box 40, the clamping force to the structure to which the box 40 is mounted, and so on. The side wall mounts 46 again are attached to the structure, by any suitable means such as threaded fasteners, not shown. A secondary parcel gate 68 is also illustrated in the large top lid 56.

Figure 3:
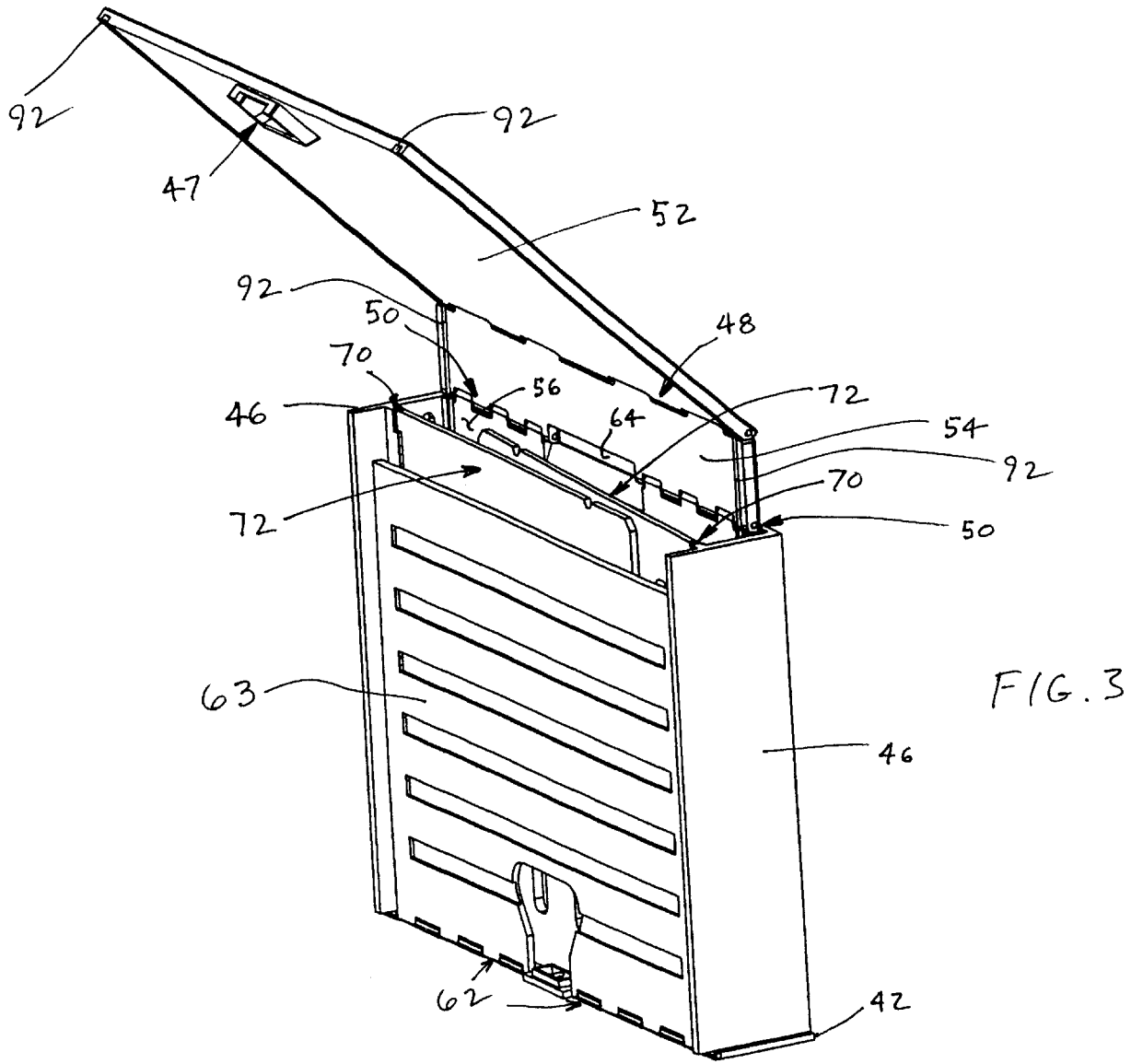
FIG. 3 illustrates a perspective view of the embodiment illustrated in FIGS. 1–2, taken from the front, right hand side and above, in an early stage of deployment.
Figure 4:
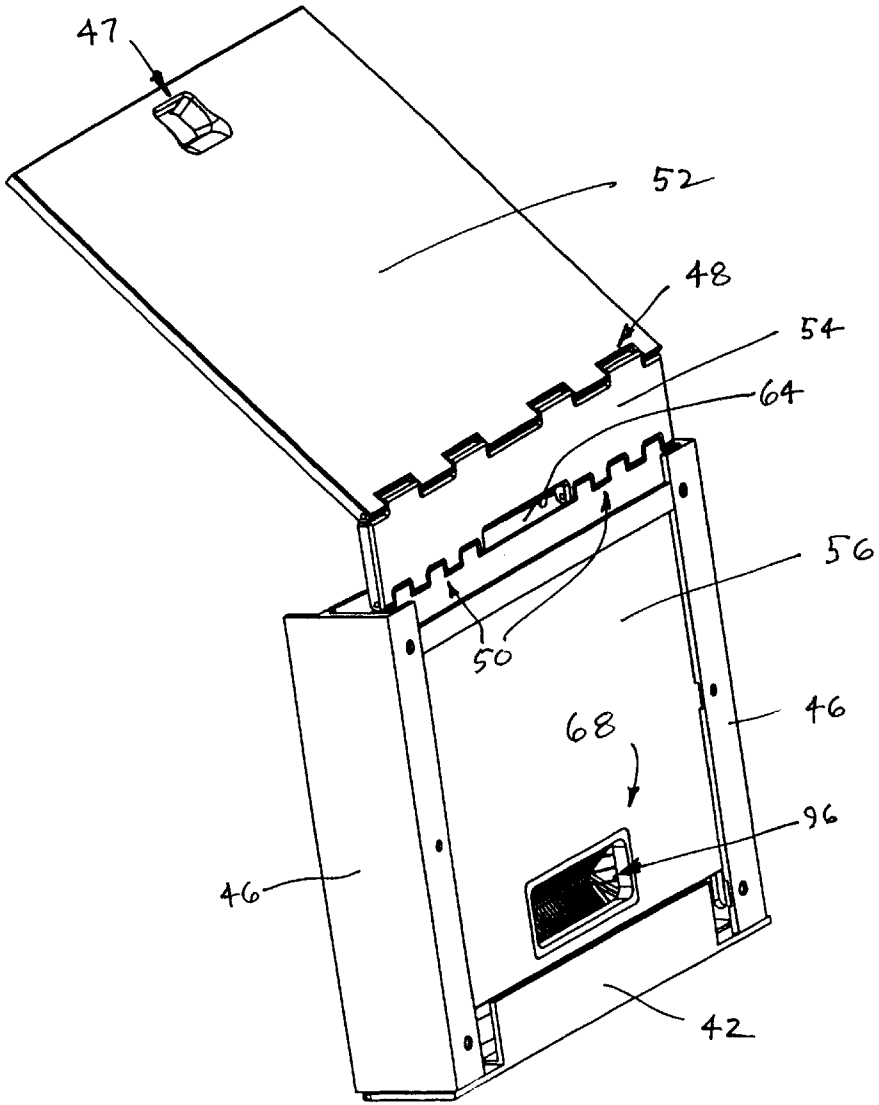
FIG. 4 illustrates a perspective view of the embodiment illustrated in FIGS. 1–3, taken from the rear, right hand side and above, in the same stage of deployment as FIG. 3.

FIG. 3 illustrates a first step in opening the fold-out parcel receiving box 40. The edge of the front door 52 is grasped, lifted slightly, and then rotated away from the closed position exposing the internal components. Hinges 70 between the side wall mounts 46 and a pair of identical side walls 72 are clearly visible in this view. FIG. 4 illustrates a rear view of the parcel receiving box 40 during this first step in the opening process.

Figure 5:
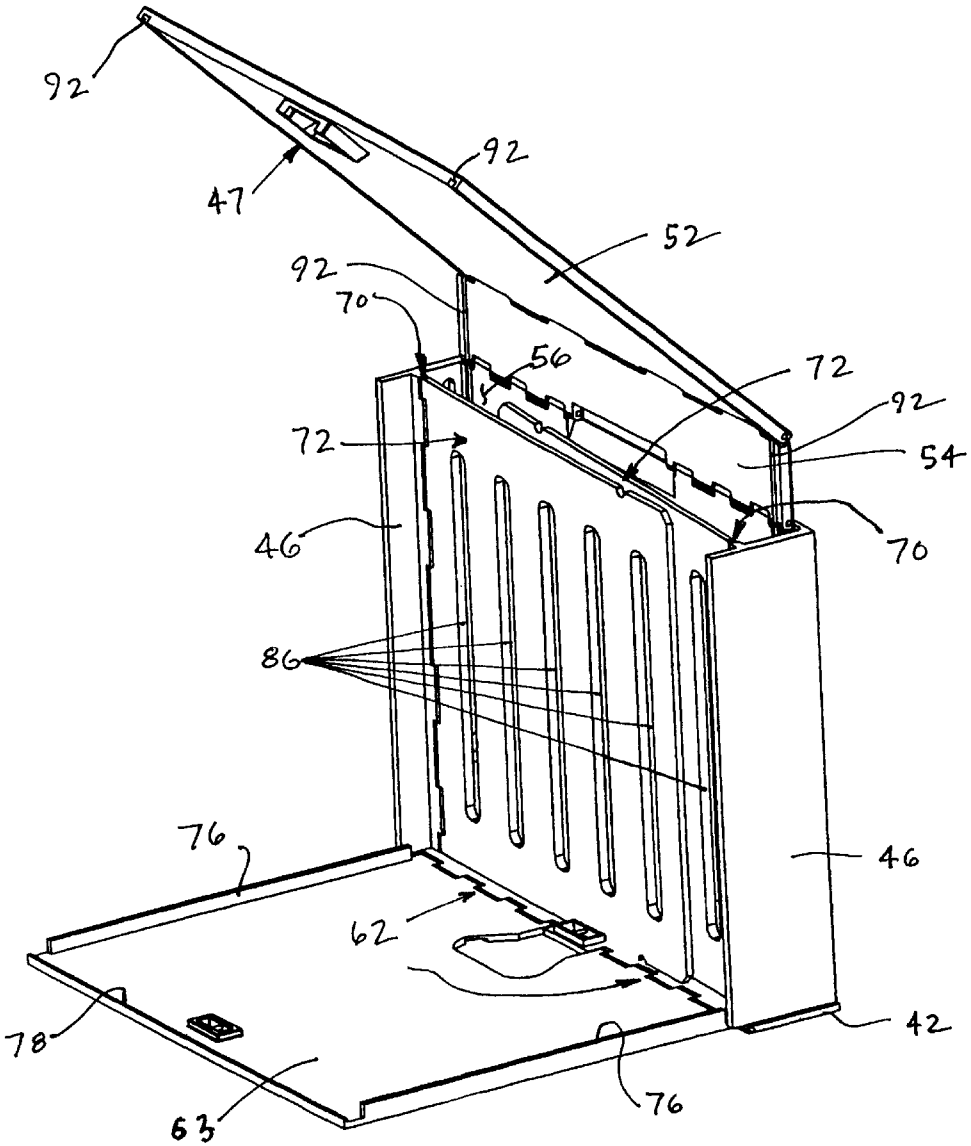
FIG. 5 illustrates a perspective view of the embodiment illustrated in FIGS. 1–4, taken from the front, right hand side and above, in a subsequent stage of deployment.

FIG. 5 illustrates the drawbridge 63 in the open position. The user deploys the drawbridge 63 after lifting the front door 52 out of the way. The drawbridge side walls 76 are illustrated in this view. The drawbridge side walls 76 restrain the left and right side walls 72 from over rotating during set up. The drawbridge side walls 76 also reduce the likelihood of possible pivot access by unauthorized personnel. The drawbridge door front wall 78, which also reduces the likelihood of possible pivot access by unauthorized personnel, is also illustrated.

Figure 6:
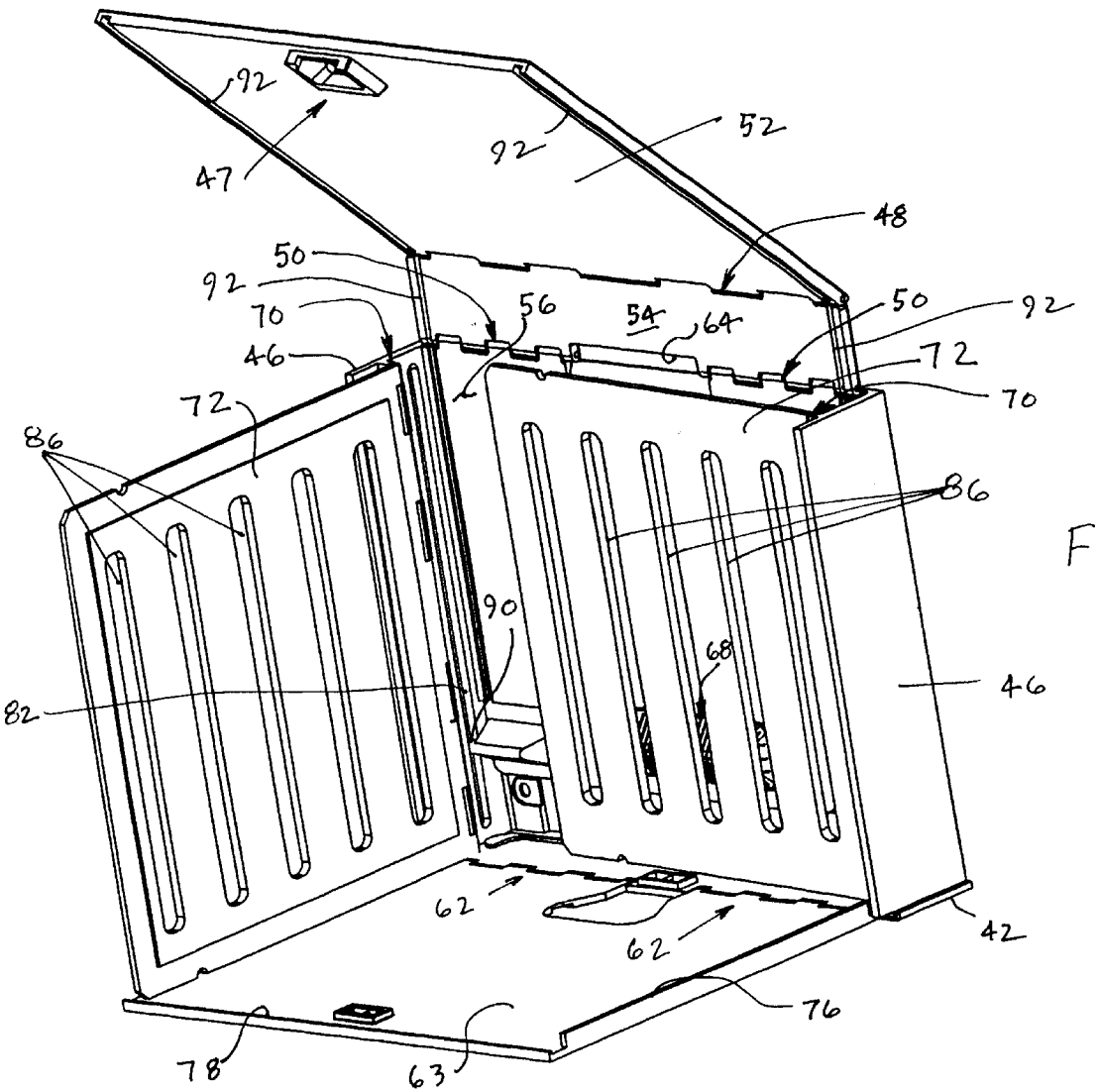
FIG. 6 illustrates a perspective view of the embodiment illustrated in FIGS. 1–5, taken from the front, right hand side and above, in yet a subsequent stage of deployment.

FIG. 6 illustrates the left side wall 72 rotated out to its open position.

The right side wall 72 is illustrated in its closed position. A guide slot 82 is illustrated in the side wall mount 46.

Figure 7:
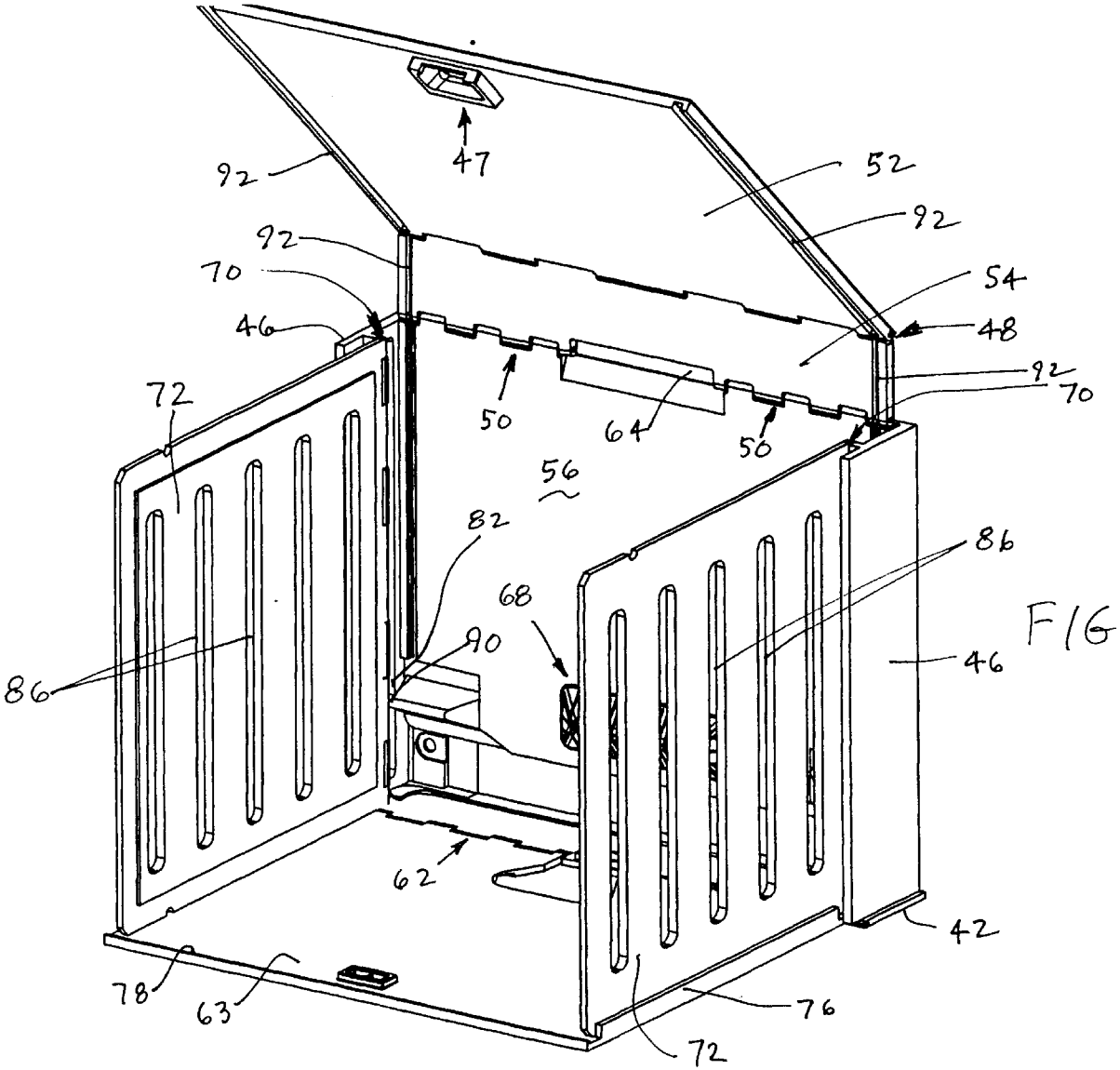
FIG. 7 illustrates a perspective view of the embodiment illustrated in FIGS. 1–6, taken from the front, right hand side and above, in yet a further stage of deployment.

FIG. 7 illustrates the left and right side walls 72 in their open positions. In the illustrated embodiments, the left and right side walls 72 are symmetric, which provides the added benefit that one part can be used for both sides, which reduces tooling costs. The side walls 72 are illustrated as having vents 86 in a particular pattern. However, it should be understood that vents 86 of any type, or no vents at all, are within the contemplation of this invention.

Figure 8:
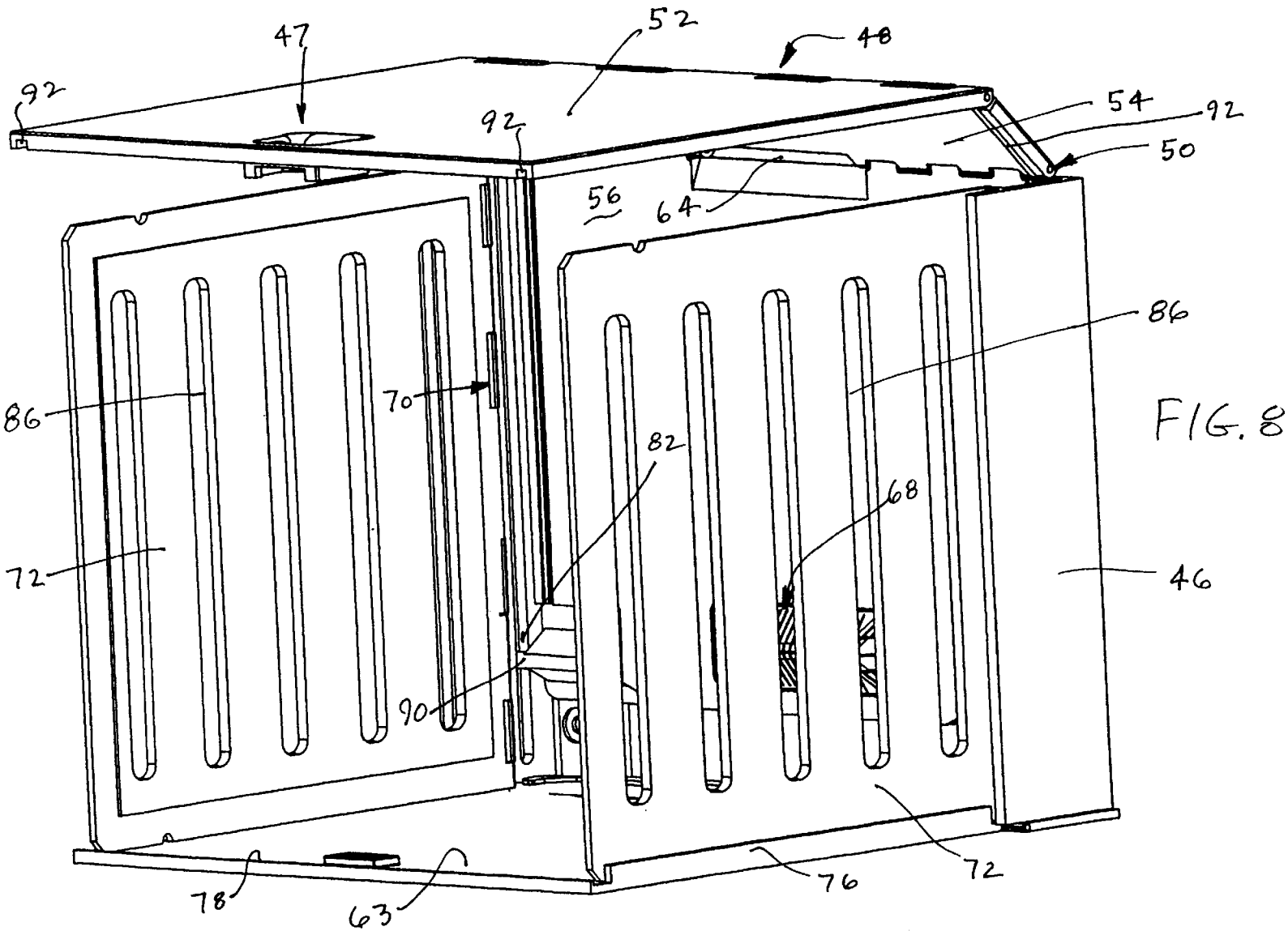
FIG. 8 illustrates a perspective view of the embodiment illustrated in FIGS. 1–7, taken from the front, right hand side and above, in a still further stage of deployment.

FIG. 8 illustrates the front door 52 and small top lid 54 oriented above the fully deployed side walls 72. This orientation permits placement of parcels into the parcel box 40 before it is closed.

Figure 9:
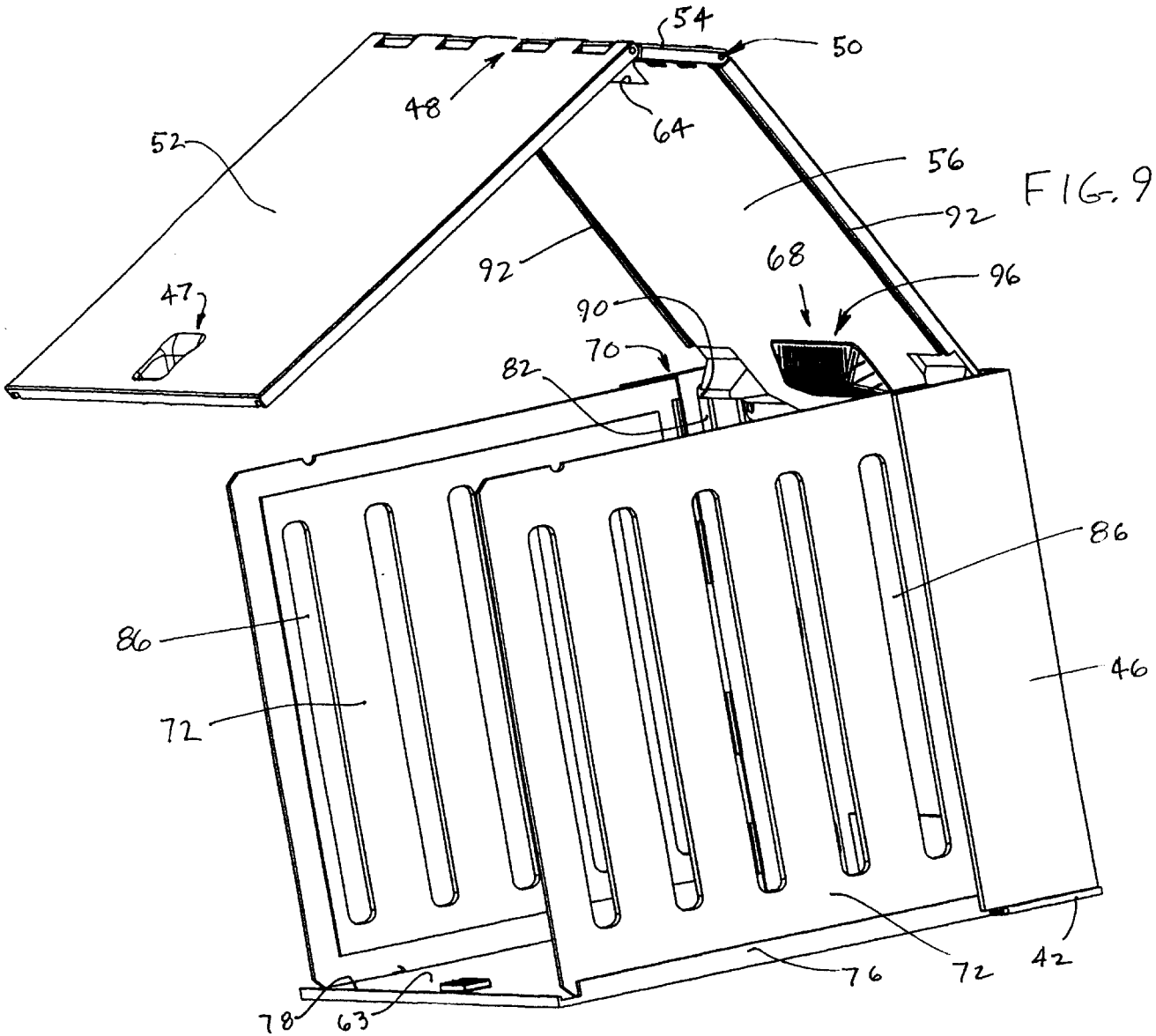
FIG. 9 illustrates a perspective view of the embodiment illustrated in FIGS. 1–8, taken from the front, right hand side and above, in yet a further stage of deployment.

FIG. 9 illustrates the large top lid 56 being slid upward along the guide slots 82 and rotated toward closure. The front door 52 and small top lid 54 pivot about their hinge axes 48, 50. Pivot pins 90 provided on the large top lid 56 engage guide slots 82, securing the large top lid 56 to the side wall mount 46. Grooves 92 provided in the front door 52, small top lid 54 and the large top lid 56, engage the edges of the side walls 72. The side walls 72 are retained by the hinges 70 between themselves and the side wall mounts 46 and by the side walls 72 fitting into the grooves 92.

Figure 10:
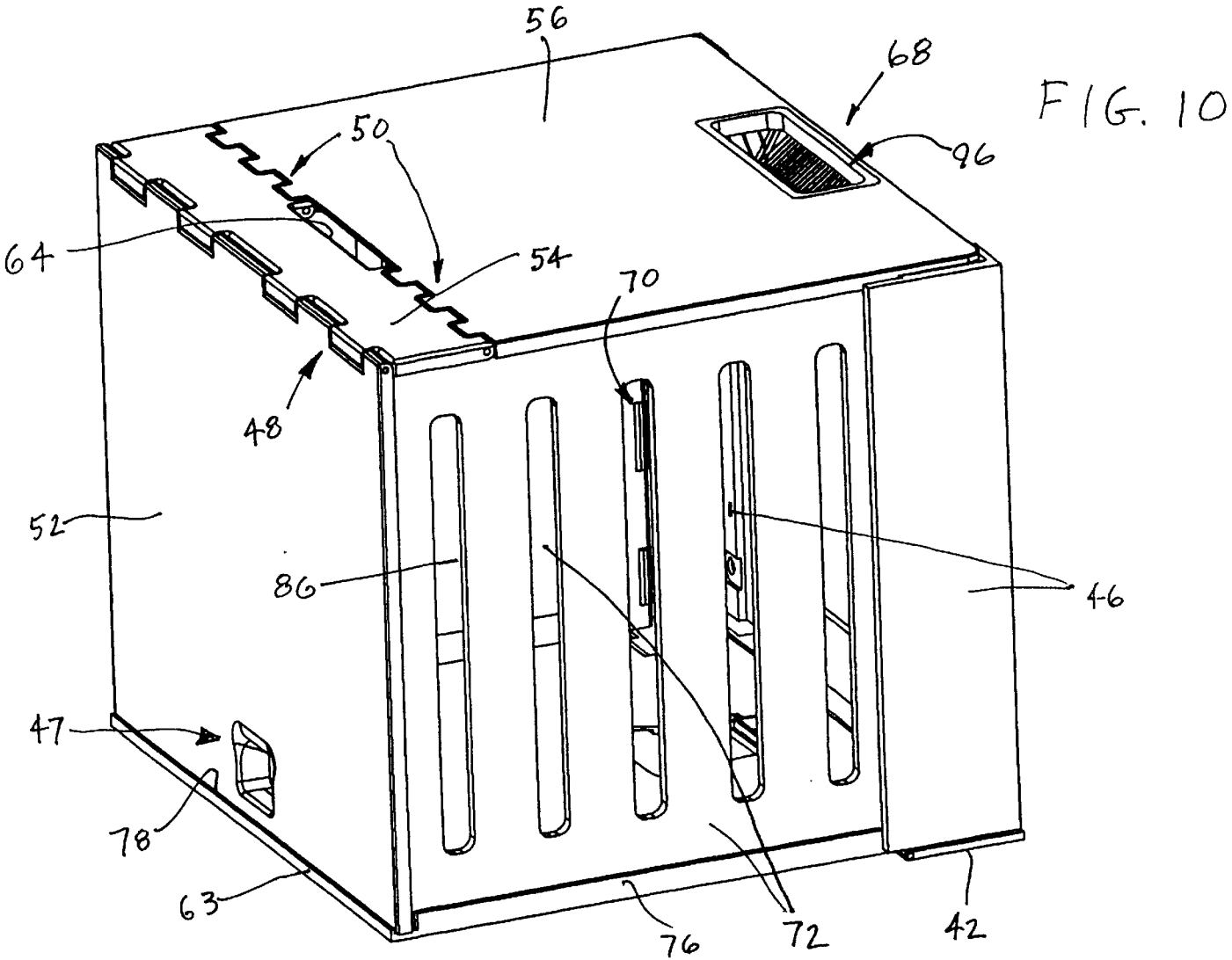
FIGS. 10–11 illustrate perspective views of the embodiment illustrated in FIGS. 1–9, taken from the front, right hand side and above, fully deployed.
Figure 11:
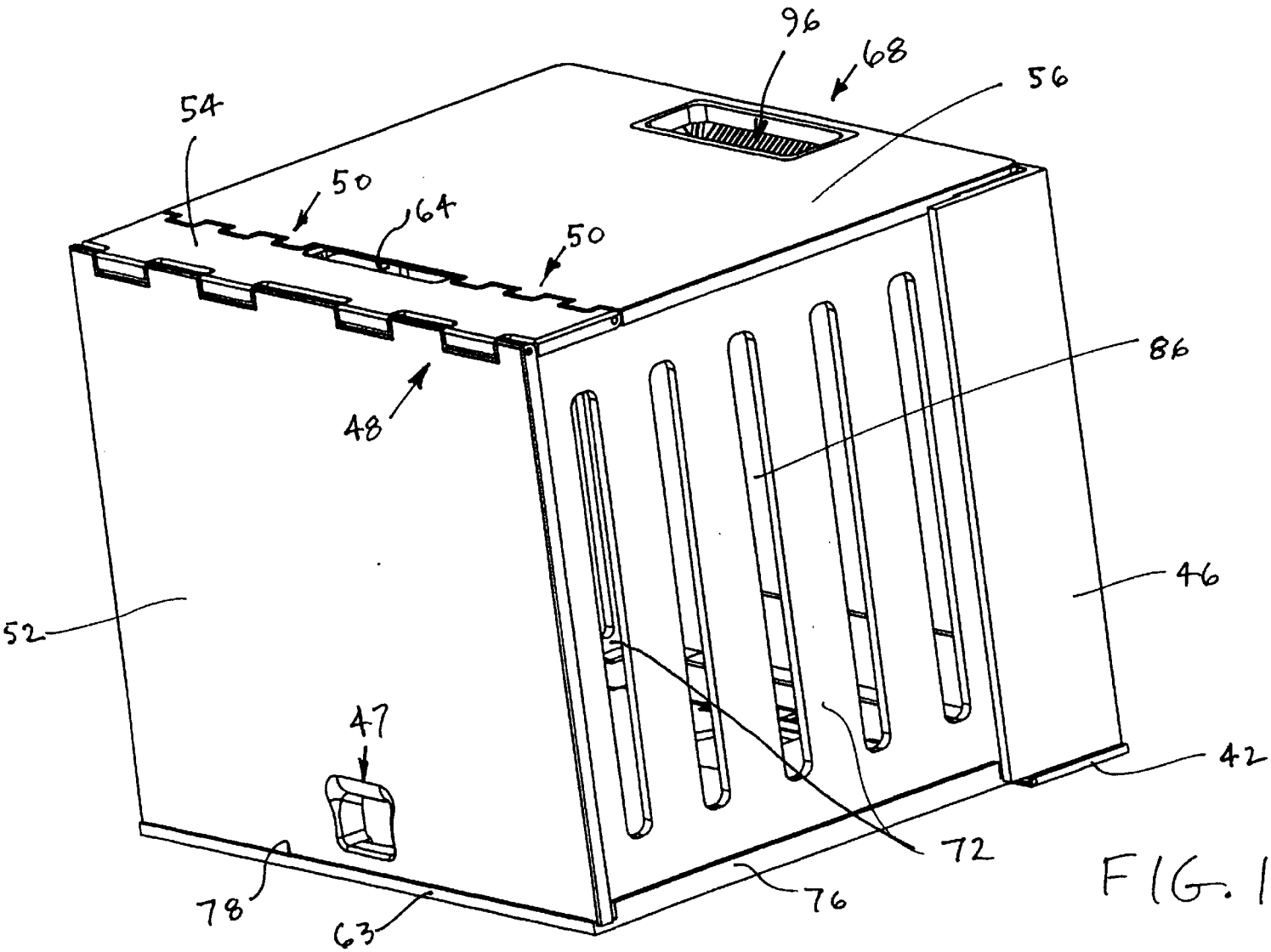

FIGS. 10 and 11 illustrate the fold out parcel receiving box 40 fully deployed, in the orientation in which it would appear with deposited delivered parcels secured in it. Since parcel delivery services deliver parcels at different times of day, the fold-out parcel delivery box 40 should be made to accommodate deliveries made after parcels are placed in the box 40 and the box 40 closed and locked. In the illustrated embodiment, parcels can be delivered after the box 40 has be closed by using the secondary parcel gate 68. The secondary parcel gate 68 is large enough to accept packages in standard sizes delivered by several of the delivery services. The secondary parcel gate 68 includes inwardly pointing fingers 96 which permit such packages to be inserted into the fold-out parcel receiving box 40. These same fingers 96 reduce the likelihood that anyone will be able to remove parcels through the secondary parcel gate 68. Slot 64 accepts letter size mail. Storage of the parcel receiving box 40 after removal of parcels from it.

Figure 12:
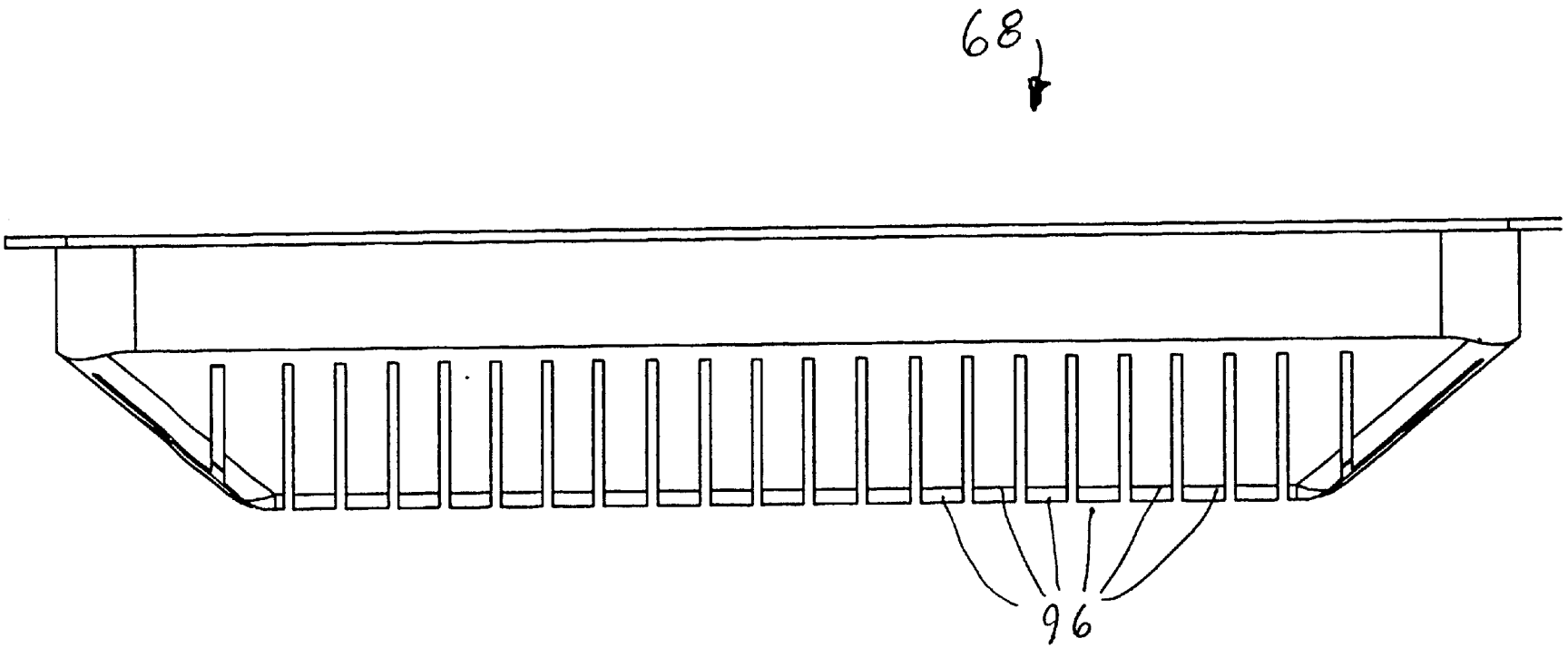
FIG. 12 illustrates a side elevational view of a component of the system illustrated in FIGS. 1–11.

FIG. 12 illustrates a side view of the secondary parcel gate 68, illustrating the downward locking finger 96 configuration.

Figure 13:
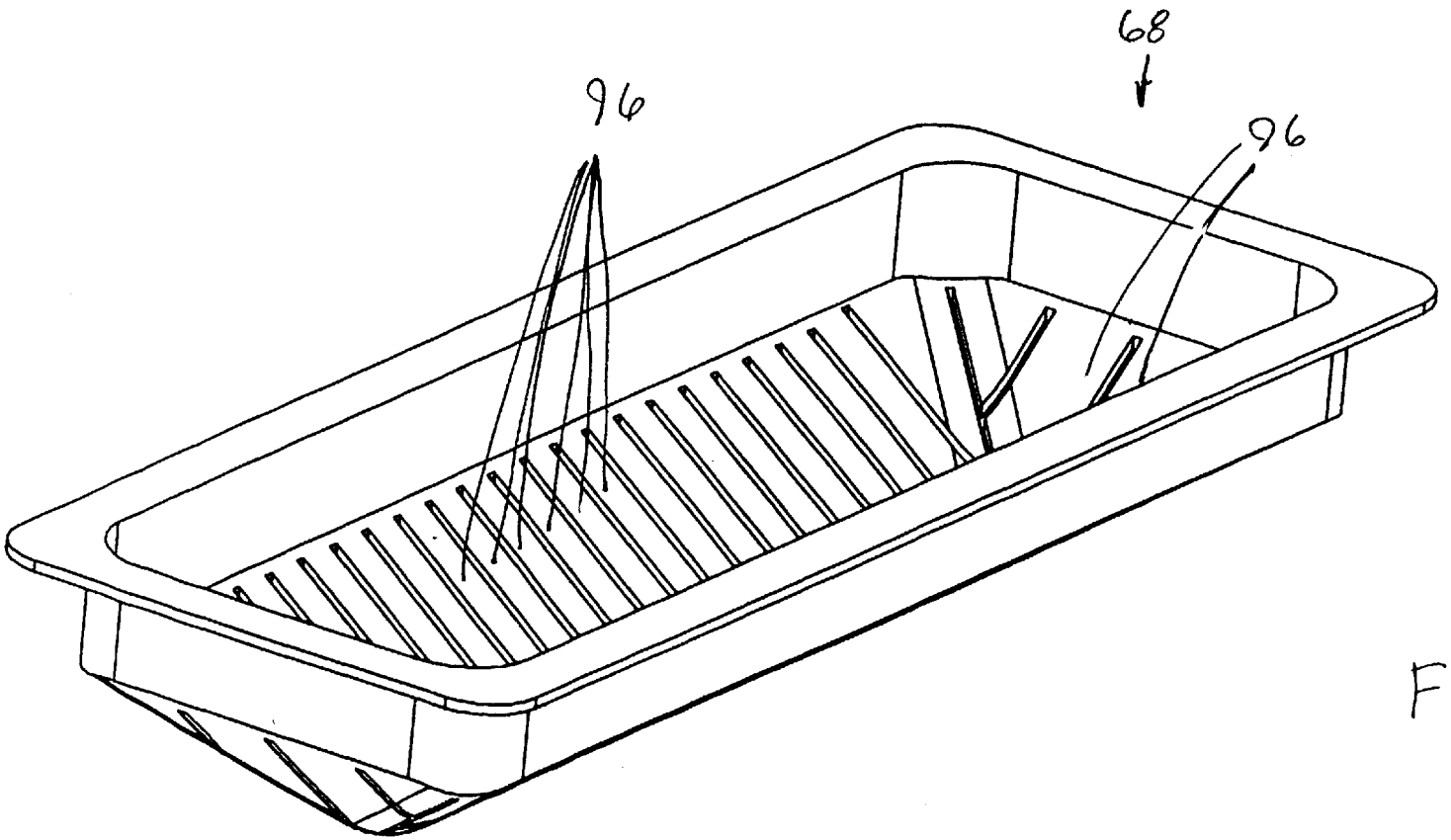
FIG. 13 illustrates a perspective view from the front, right side and above, of the component illustrated in FIG. 12.

FIG. 13 illustrates a isometric view of the secondary parcel gate 68.

Figure 14:
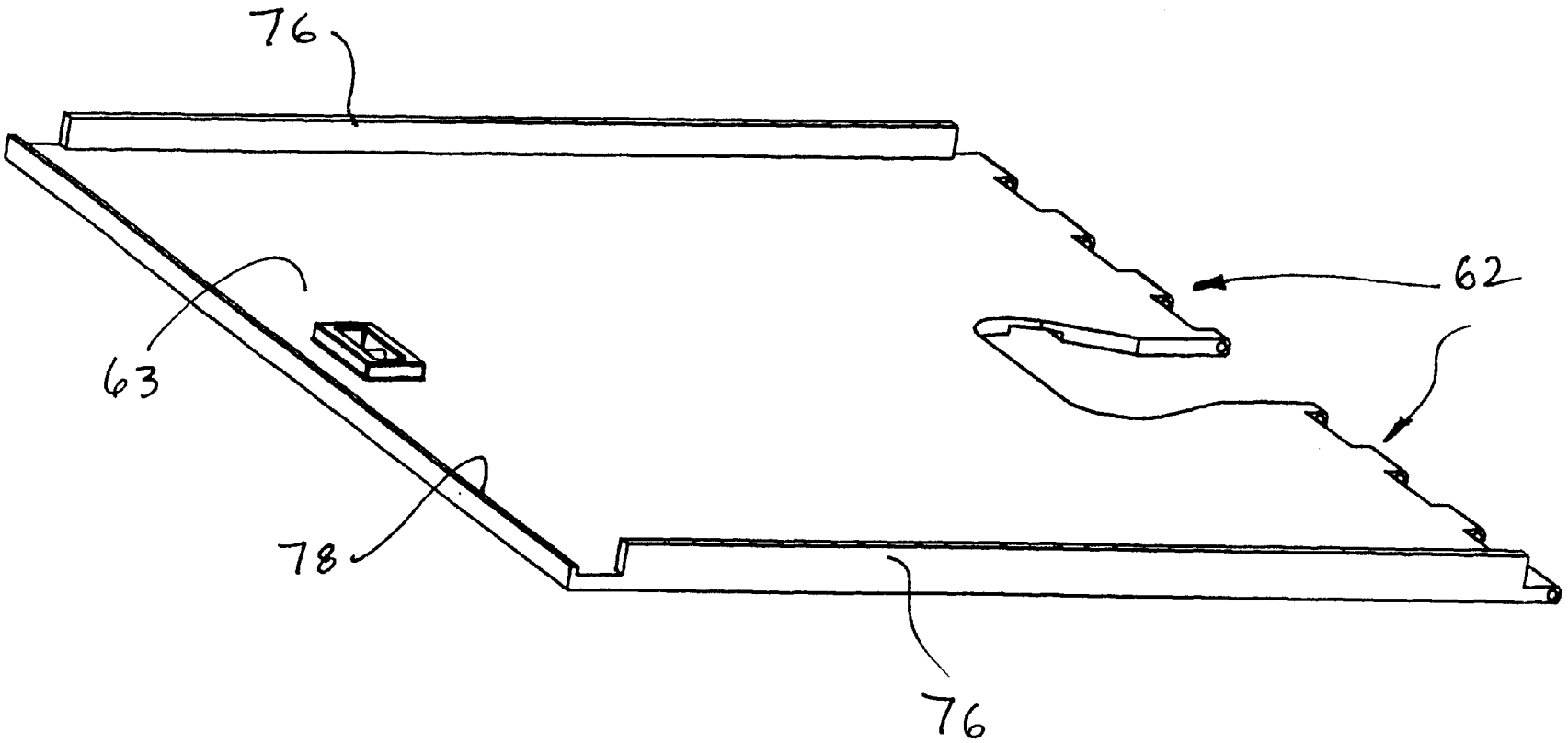
FIG. 14 illustrates a perspective view of another component of the system illustrated in FIGS. 1–11.

FIG. 14 illustrates the drawbridge door 63.

Figure 15:
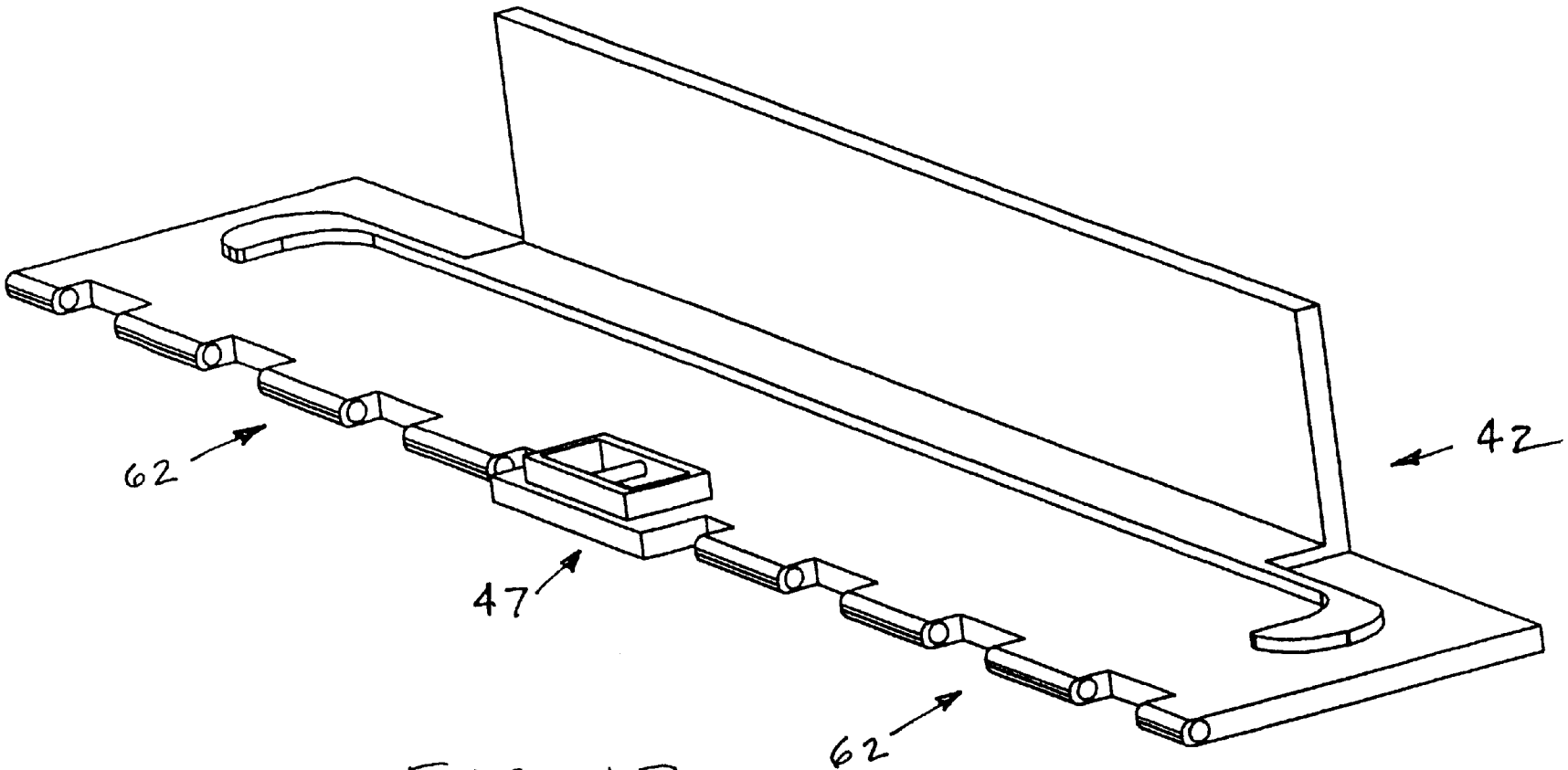
FIG. 15 illustrates a perspective view of another component of the system illustrated in FIGS. 1–11.

FIG. 15 illustrates the mount plate 42.

Figure 16:
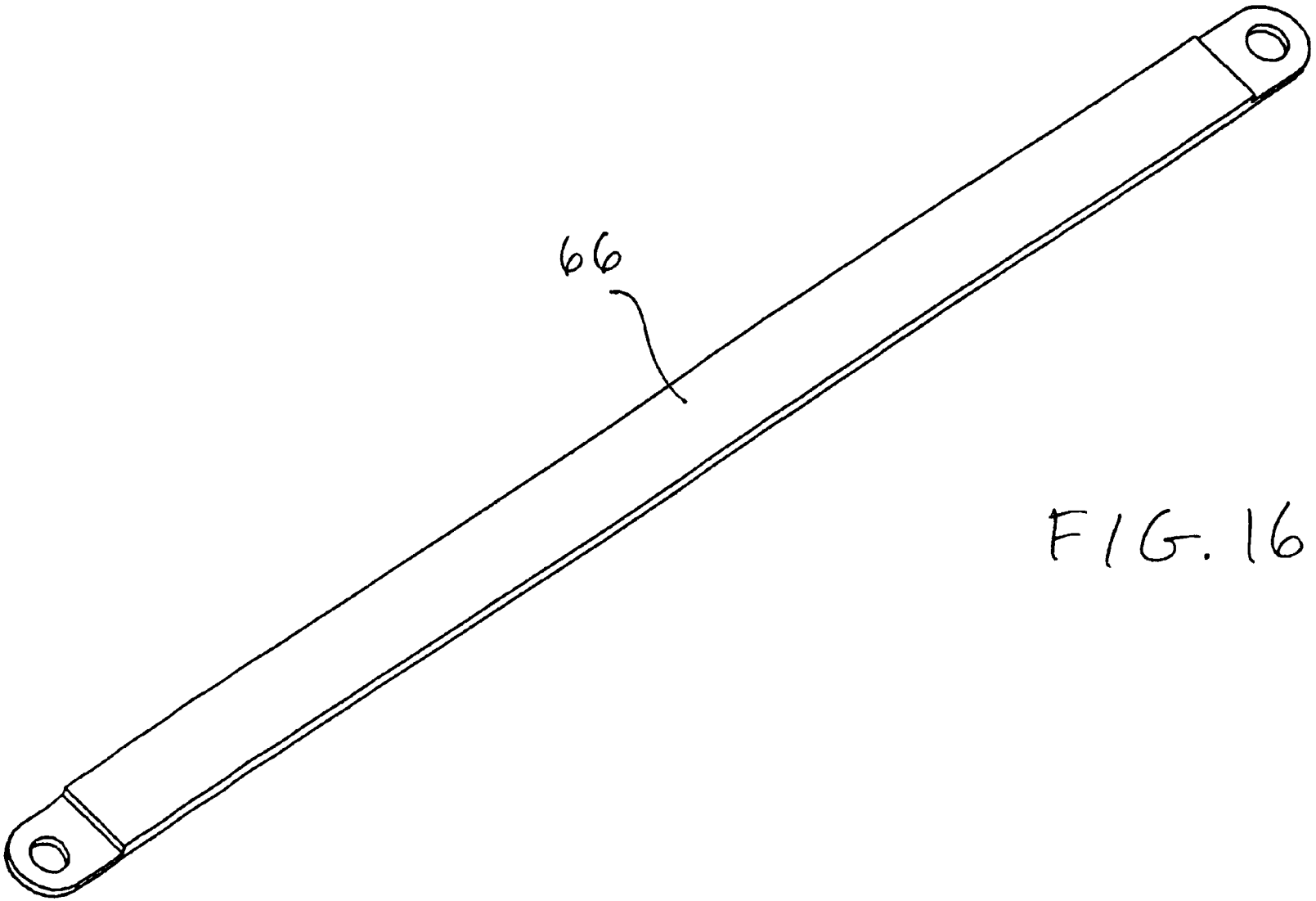
FIG. 16 illustrates a perspective view of another component of the system illustrated in FIGS. 1–11.

FIG. 16 illustrates the brace bar

Figure 17:
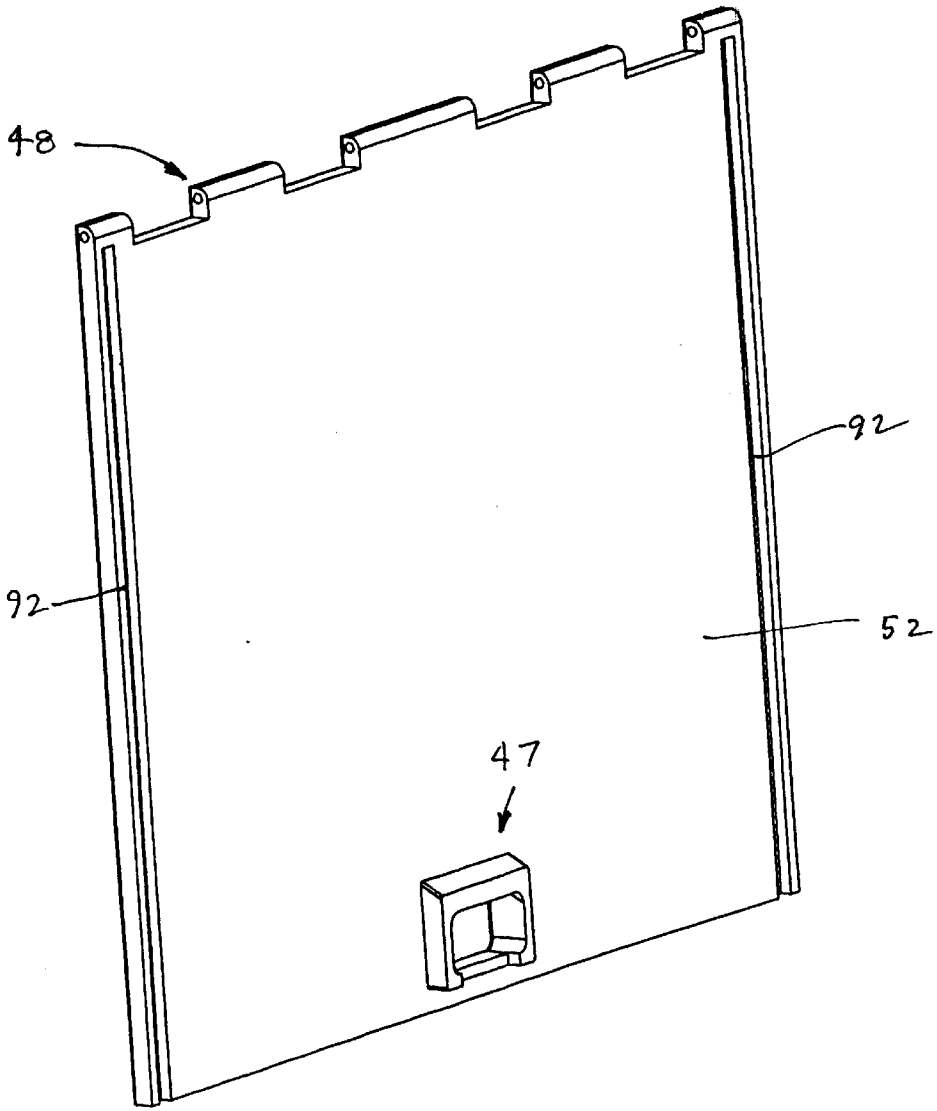
FIG. 17 illustrates a perspective view of another component of the system illustrated in FIGS. 1–11.

FIG. 17 illustrates the front door 52, illustrating the grooves 92 used to restrain the left and right side, side walls 72.

Figure 18:
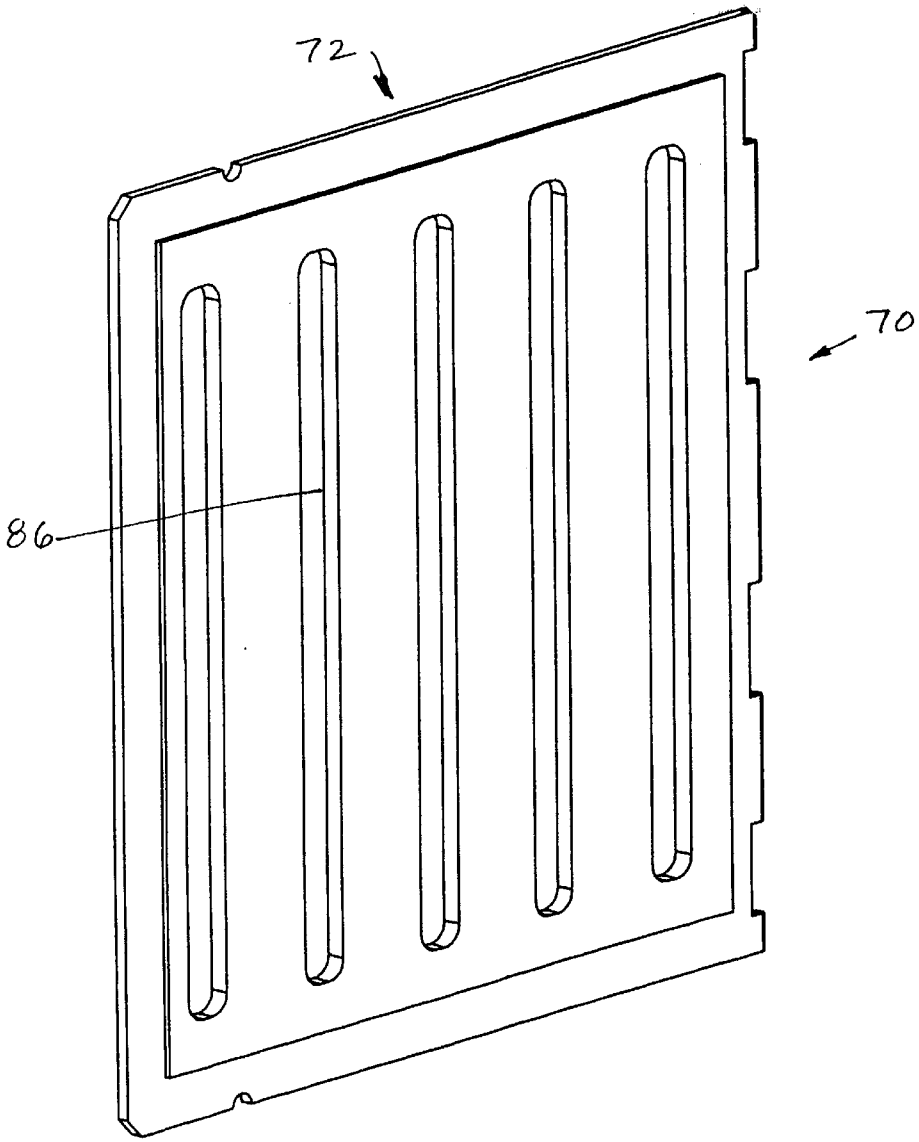
FIG. 18 illustrates a perspective view of another component of the system illustrated in FIGS. 1–11.

FIG. 18 illustrates the left/right side wall 72. As previously noted, the configuration of the side wall 72 is symmetric, so that the side wall 72 can be used for either the left side or the right side. A typical vent pattern is illustrated.

Figure 19:
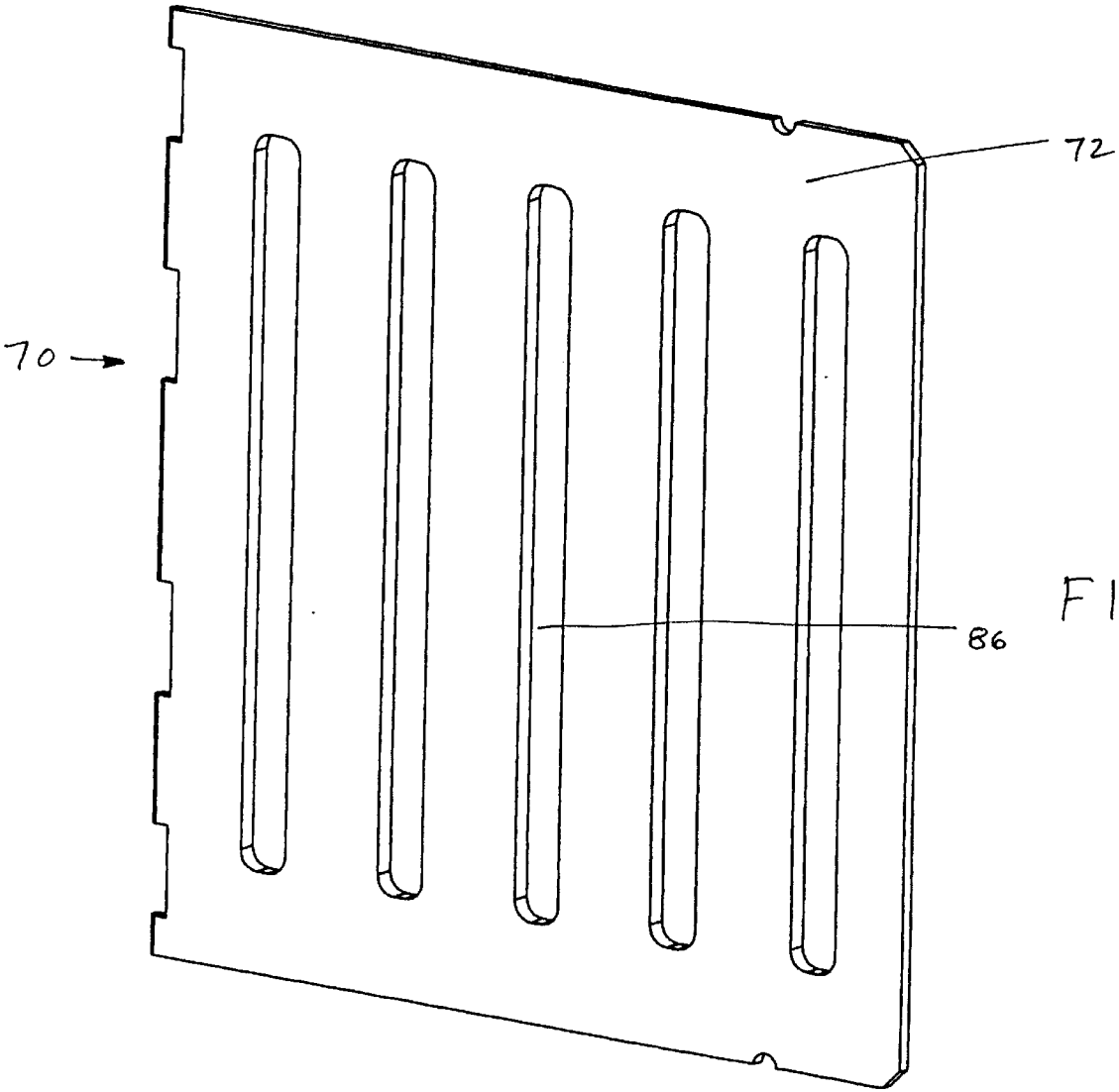
FIG. 19 illustrates a perspective view of the component illustrated in FIG. 18, taken from the other side.

FIG. 19 illustrates the outside view of the left/right side wall 72.

Figure 20:
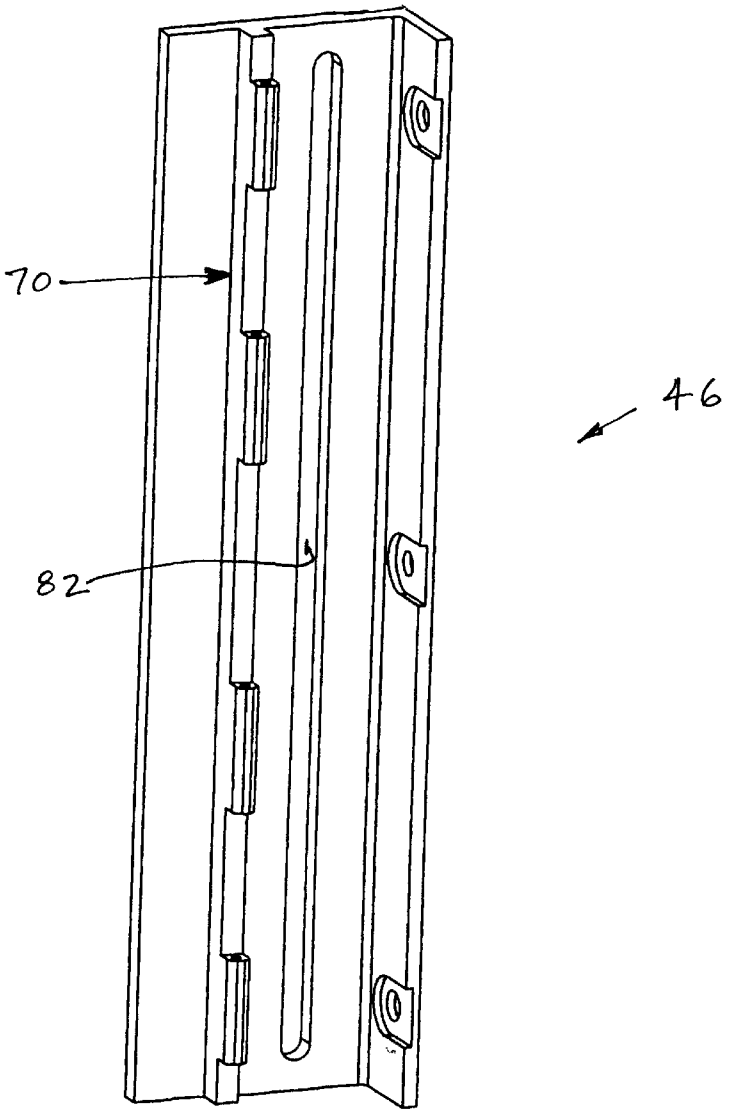
FIG. 20 illustrates a perspective view of another component of the system illustrated in FIGS. 1–11.

FIG. 20 illustrates the side wall mount 46. The bolt hole locations, the guide slot 82 and the hinged joint 70 between the side walls 72 and the side wall mount 46 are illustrated. As with the side wall 72, the configuration of the side wall mount 46 is symmetric, permitting the mount 46 to be used on either side of the structure.

Figure 21:
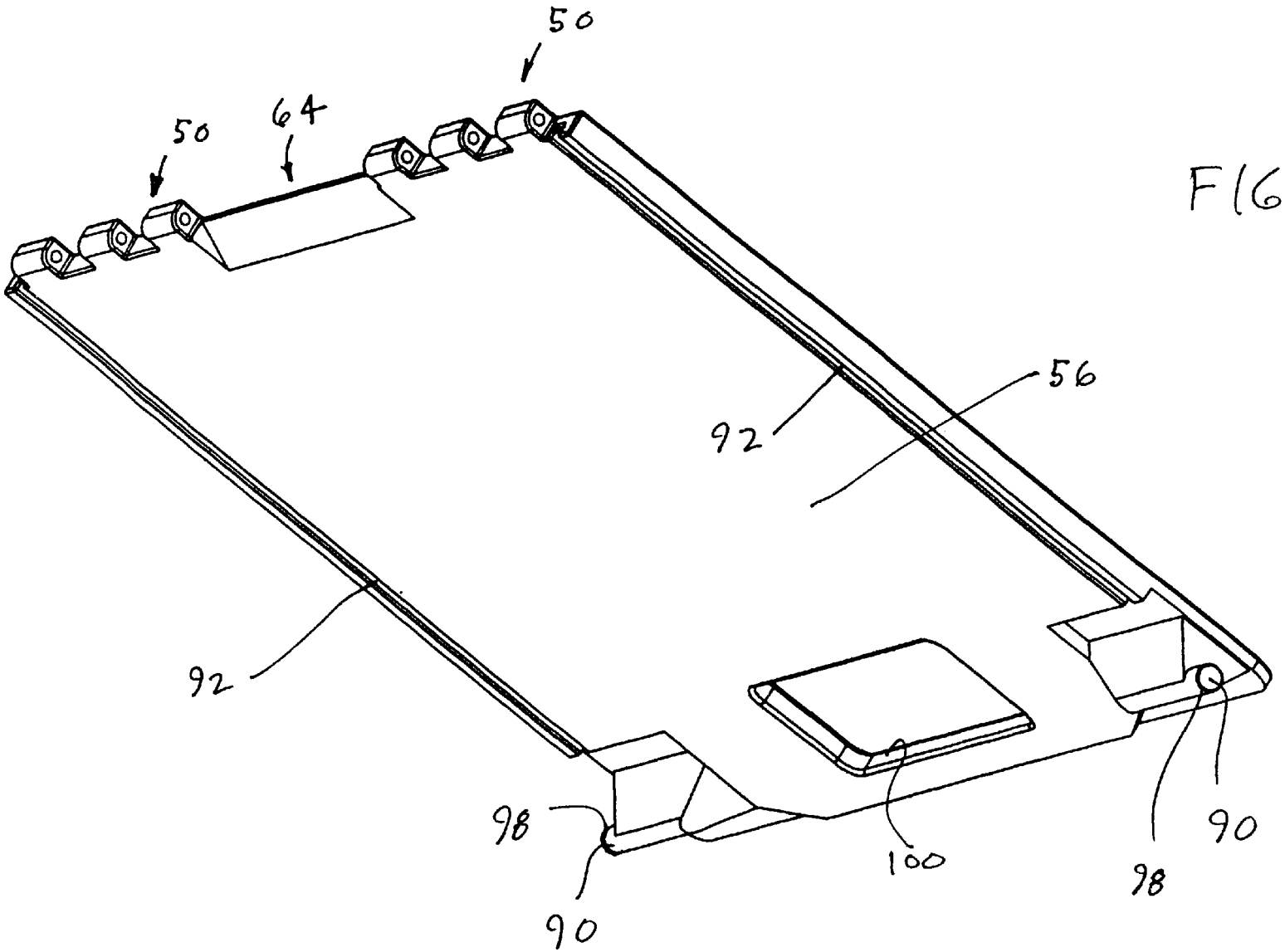
FIG. 21 illustrates a perspective view of another component of the system illustrated in FIGS. 1–11.

FIG. 21 illustrates the large top lid 56. The pivot pins 90 engage in the guide slots 82 and have enlarged diameter ends 98 which engage enlarged sections of the guide slots 82 to permit movement of the pins 90 up and down in the guide slots 82 to permit deployment and storage of the box 40 but restricts the pivot pins 90 from being pulled out of their respective guide slots 82. The opening 100 into which the secondary parcel gate 68 is inserted is also illustrated.

Figure 22:
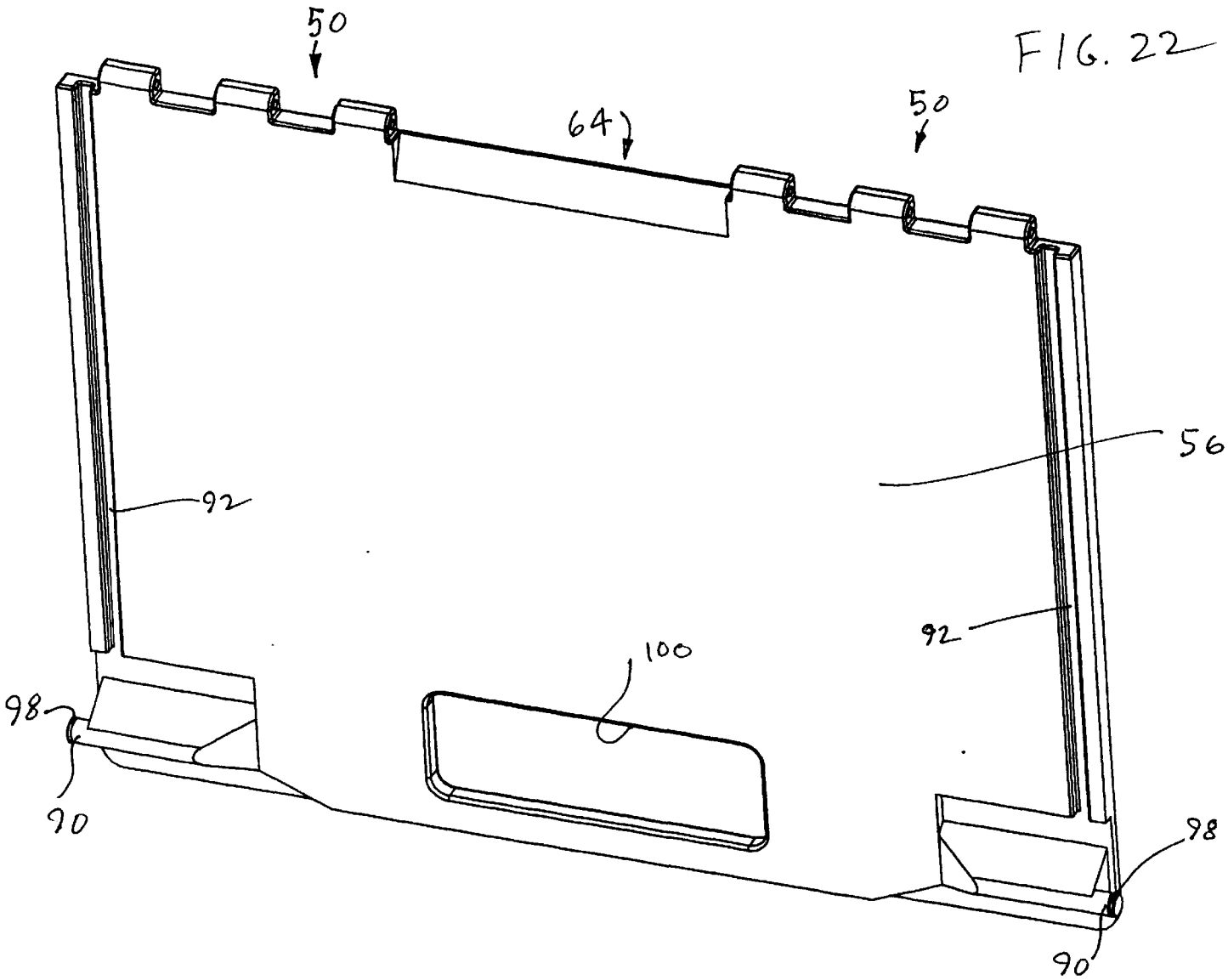
FIG. 22 illustrates another perspective view of the component illustrated in FIG. 21, taken from a different angle.

FIG. 22 illustrates the grooves 92 in the large top lid 56. The grooves 92 restrain the movement of the side walls 72.

Figure 23:
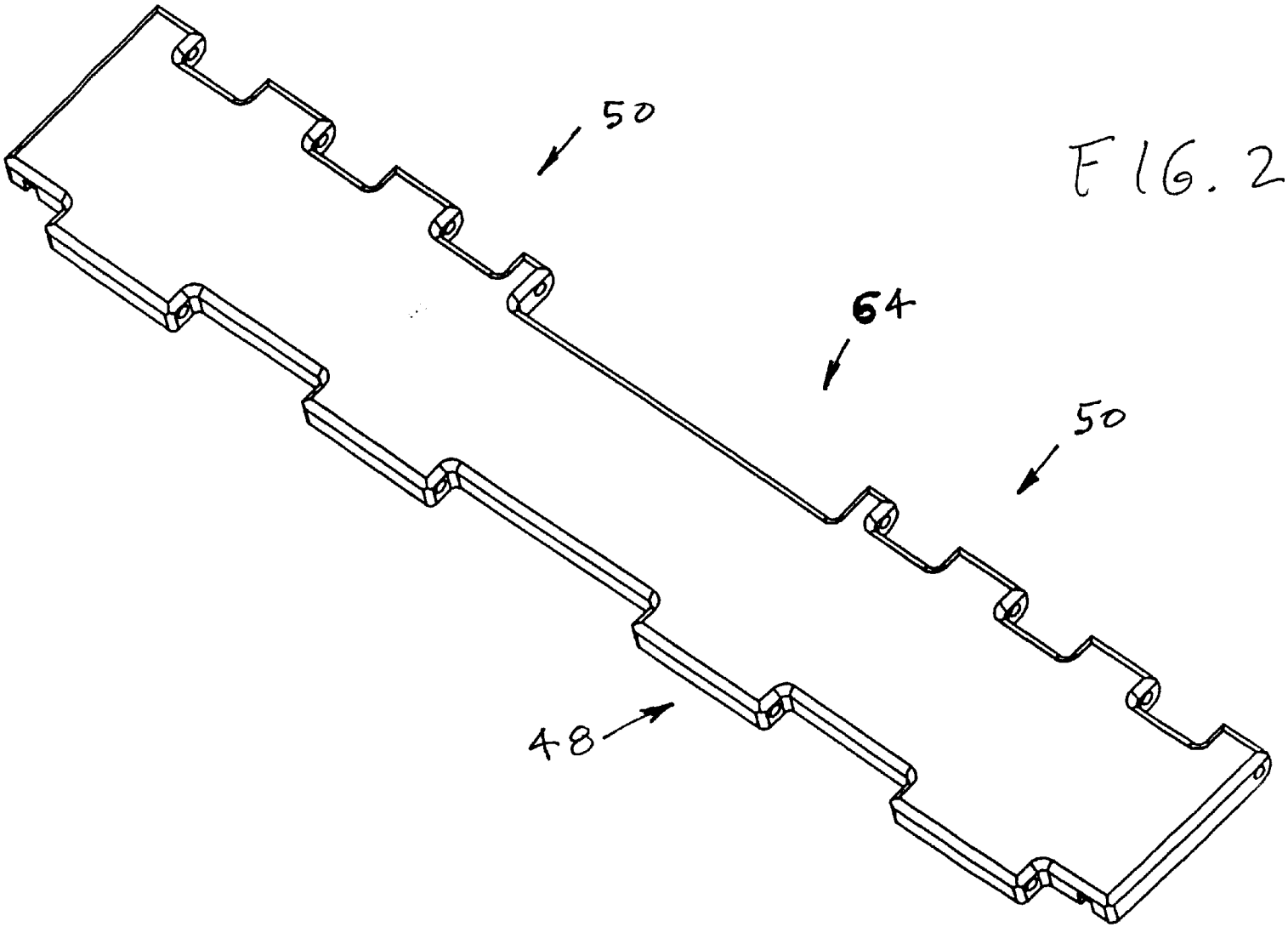
FIG. 23 illustrates a perspective view of another component of the system illustrated in FIGS. 1–11.

FIG. 23 illustrates the small top lid 54. The handle slot 64, hinge between the front door 52 and the small top lid 54 and the hinge between the small top lid 54 and the large top lid 56 are also illustrated in FIG. 22.

Figure 24:
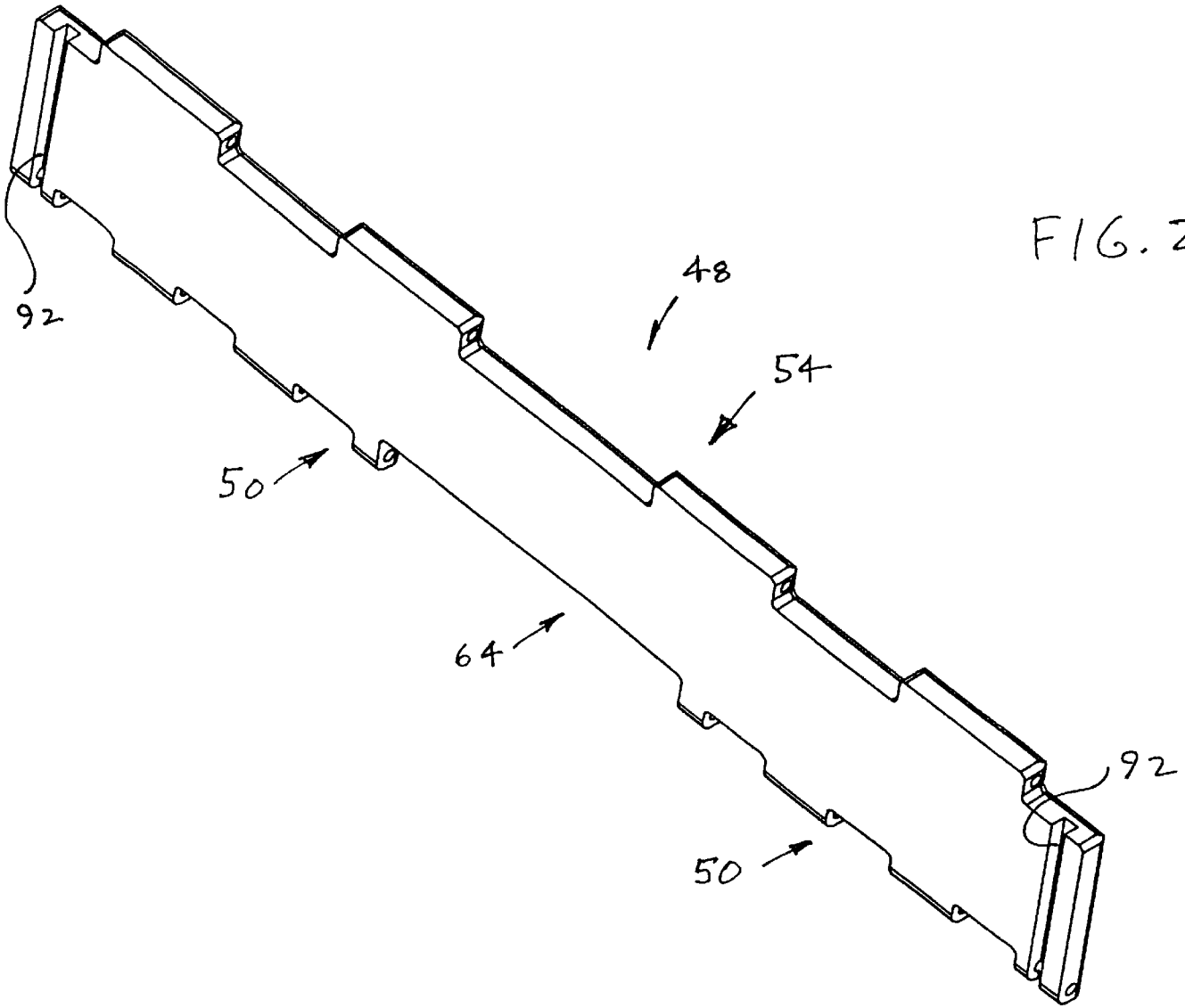
FIG. 24 illustrates another perspective view of the component illustrated in FIG. 23, taken from a different angle.

FIG. 24 illustrates an inside view of the small top lid 54. The grooves 92 that restrain the side walls 72 at the time of closure can be seen in this view. Another embodiment 140 of the parcel box is illustrated in FIGS. 25–28.

Figure 28:
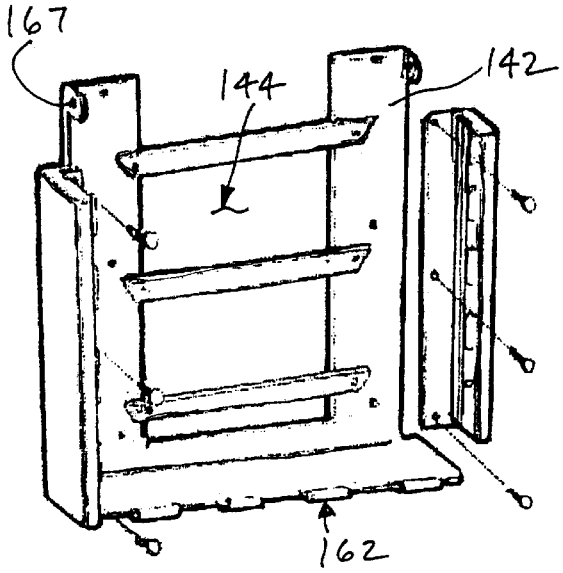
FIG. 28 illustrates an exploded perspective view, taken from the front, above and the left hand side, of certain components of the embodiment illustrated in FIGS. 25–27.

This embodiment of the parcel box 140 is adapted to be suspended from a wall 144 of a residence or the like. Like the embodiment described above, it is also foldable when not in use. FIG. 28 illustrates a wall mounting plate 142 fabricated from, for example, sheet steel. The wall mounting plate 142 is used to convert the vertical load into a shear load. The drawbridge door 163, FIG. 26, mounts to a hinge 162 at the base of the plate 142. A cable 165 is attached at 167 to the wall mounting plate 142 and to a beam 169 provided on or in drawbridge 163. Any suitable means, such as the illustrated threaded fasteners may, be used to secure the plate 142 to the wall 144.

Figure 25:
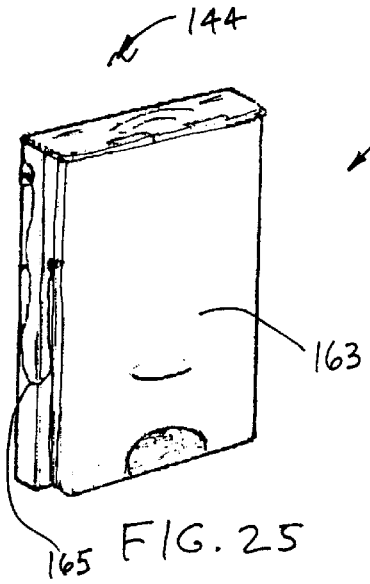
FIG. 25 illustrates a perspective view, taken from the front, above and the left hand side, of another embodiment of the invention in an undeployed orientation.

FIG. 25 illustrates the hanging fold out parcel receiving box 140 in the closed position. The cable that attaches beam 169 to the wall mounting plate 142 is illustrated in FIGS. 25–27.

Figure 26:
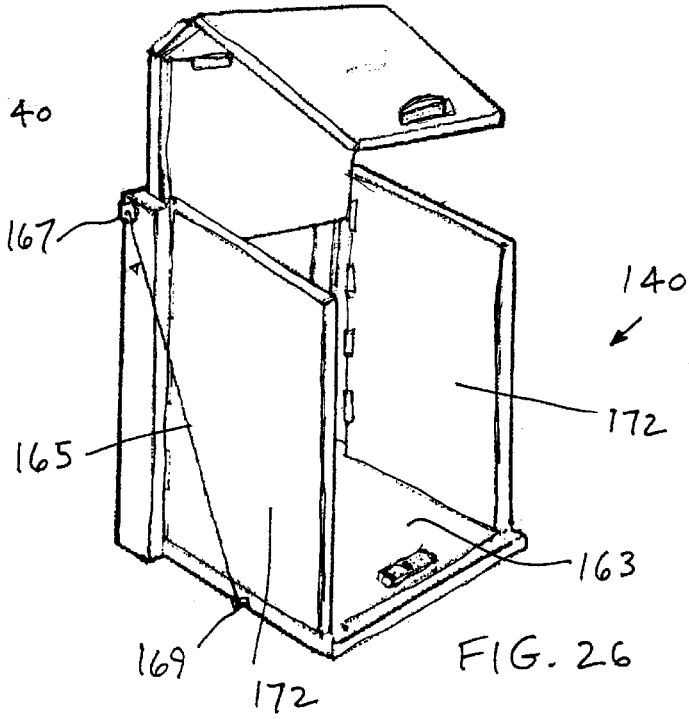
FIG. 26 illustrates a perspective view, taken from the front, above and the left hand side, of the embodiment of FIG. 25 in a partially deployed orientation.

FIG. 26 illustrates the hanging fold out parcel receiving box 140 in a partially deployed orientation. The cable 165 is drawn tight by the weight of the drawbridge 163 and side walls 172. The hanging fold out parcel receiving box 140 is deployed to receive parcels and stored after the parcels have been removed in a similar sequence to the fold out parcel receiving box 40 illustrated in FIGS. 1–24.

Figure 27:
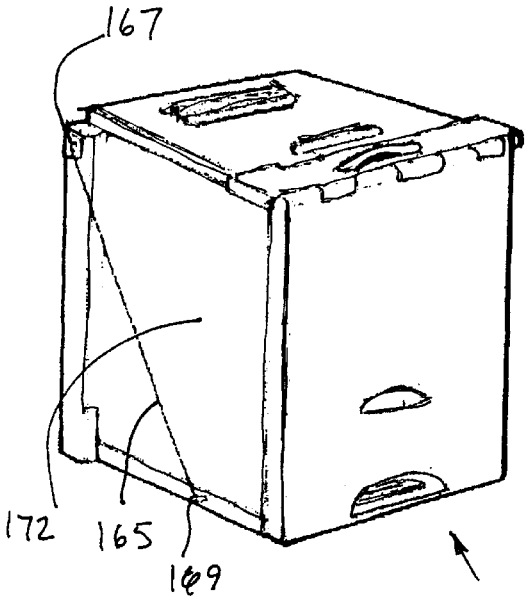
FIG. 27 illustrates a perspective view, taken from the front, above and the left hand side, of the embodiment of FIGS. 25–26 in a fully deployed orientation.

FIG. 27 illustrates the hanging fold out parcel receiving box 140 in the deployed position, holding parcels until the parcels are removed by an individual with access to the box 140.

Figure 29:
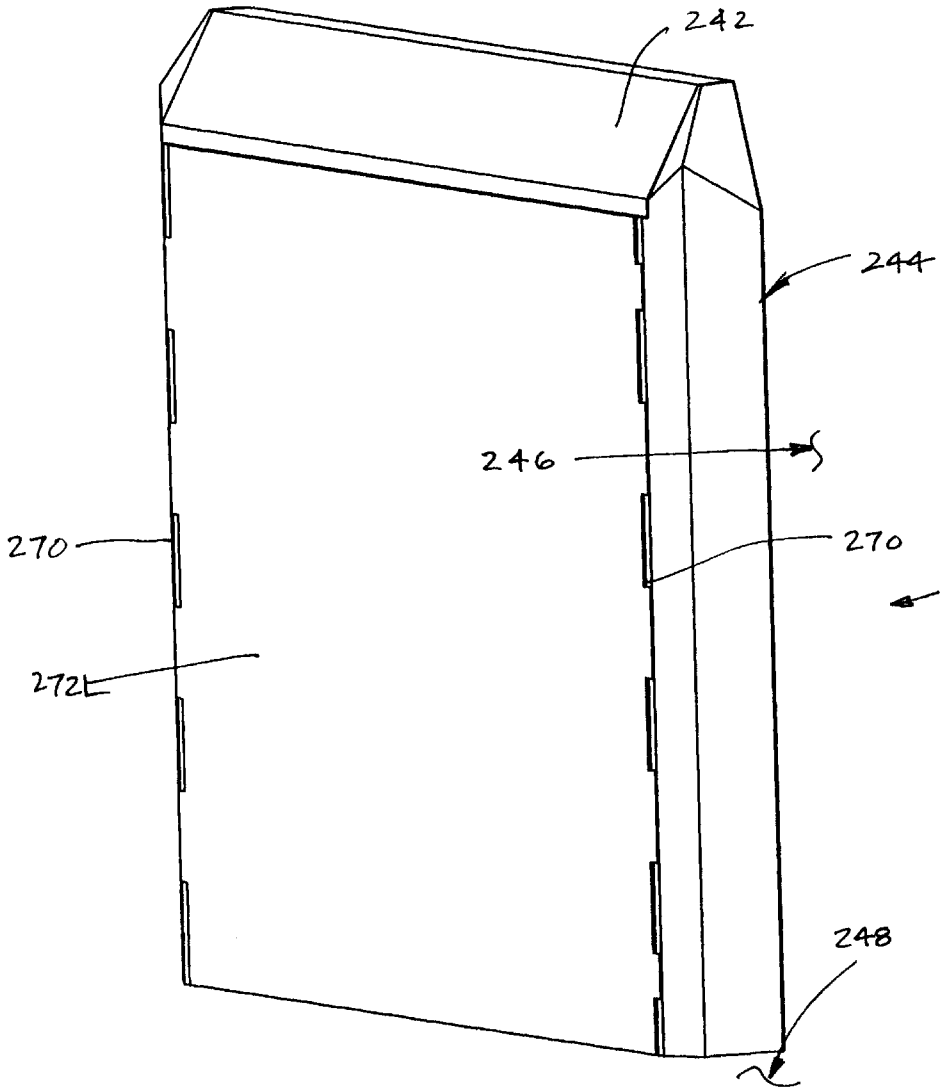
FIG. 29 illustrates a perspective view, taken from the front, above and the right hand side, of another embodiment of the invention in an undeployed orientation.

FIGS. 29–47 illustrate another embodiment of the invention. Referring particularly to FIG. 29, a swing out parcel receiving box 240 is illustrated in the undeployed position. A double hinged cover plate 242 covers the internal components of parcel box 240. A wall mount 244 mounts to a surface 246 of the house or other structure with the bottom of the wall mount 244 resting on a surface 248, such as the floor of a porch or the ground. A left side door 272 L faces outward in the closed position.

Figure 30:
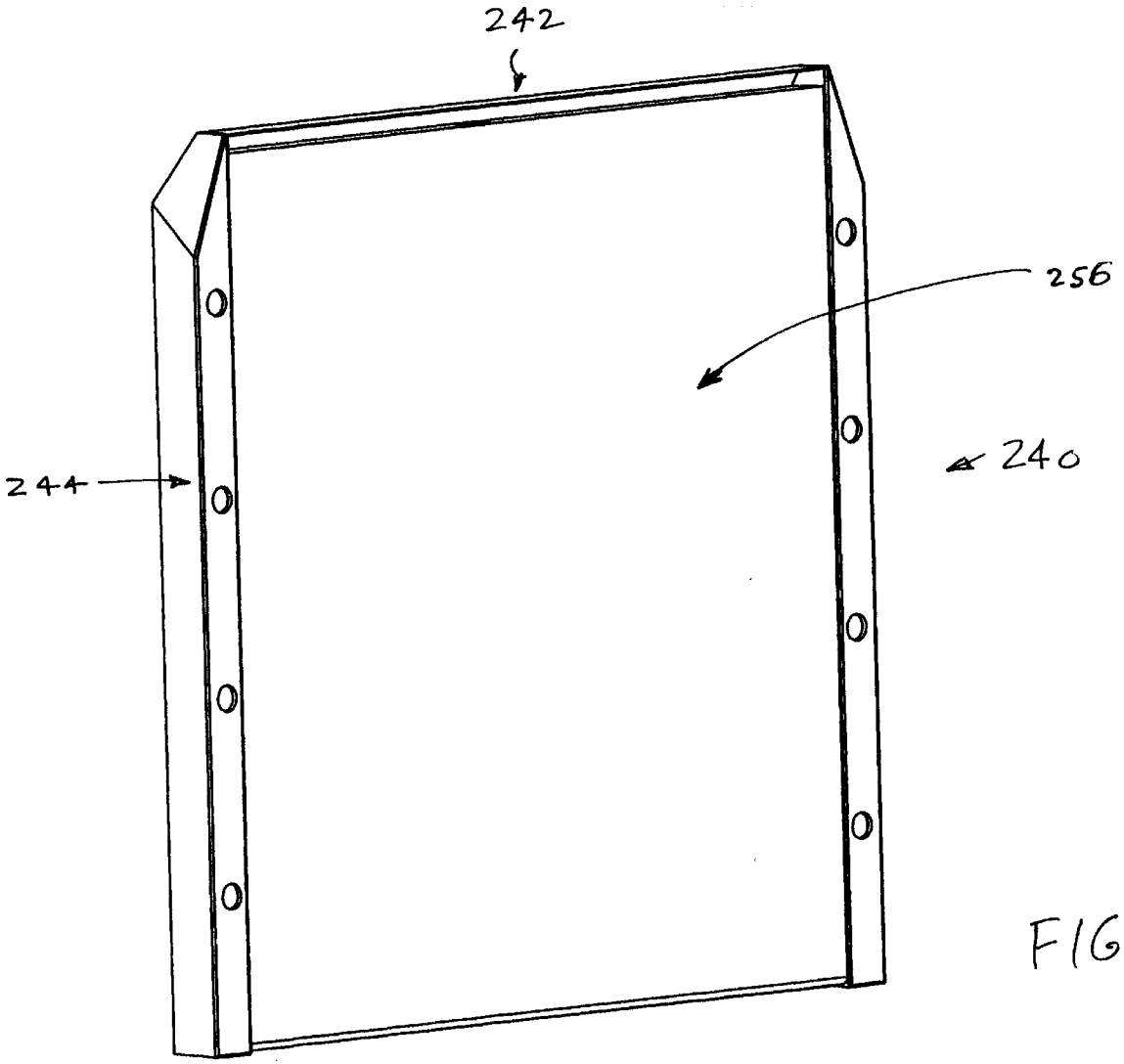
FIG. 30 illustrates a perspective view of the embodiment illustrated in FIG. 29, taken from the right rear.

FIG. 30 illustrates a rear perspective view of the parcel receiving box 240 in the undeployed orientation. Eight bolt holes are illustrated, as well as the top lid 256 in a stored position. Of course, other bolt patterns, and other attachment mechanisms can be employed to secure box 240 to the structure 246.

Figure 31:
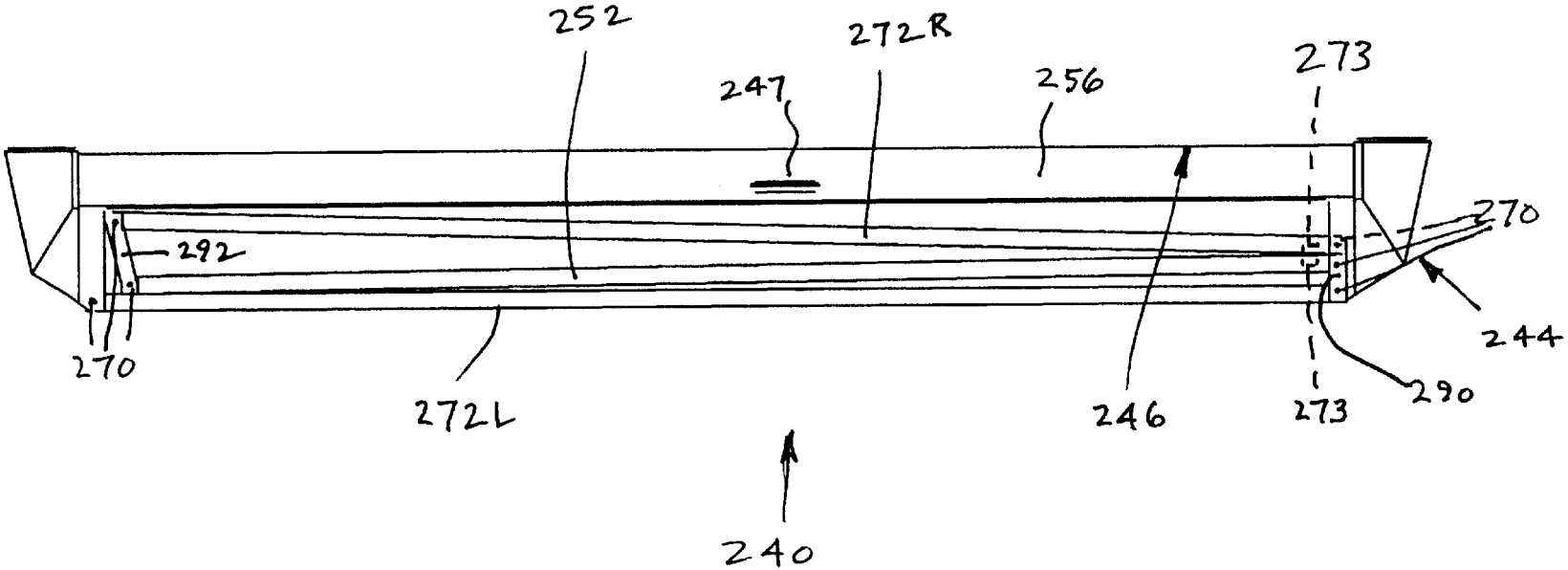
FIG. 31 illustrates a top plan view of the embodiment illustrated in FIGS. 29–30, with certain components removed for purposes of explanation.

FIG. 31 illustrates a top view of the swing out parcel receiving box 240 with the double hinged cover plate 242 removed for purposes of clarity. The left side 272 L, front 252 and right side 272 R panels are shown in their undeployed orientations. Embedded magnetic strips 273 extend at least a portion of the height of the front 252 and right side 272 R panels to maintain the box 240 in undeployed orientation. The magnetic strips 273 may be similar to the magnetic strips that extend around the perimeter of refrigerator door and/or door opening, except that they only extend for some portion of the height of the two panels 252, 272 R. The top lid 256 is illustrated in its undeployed orientation.

Figure 32:
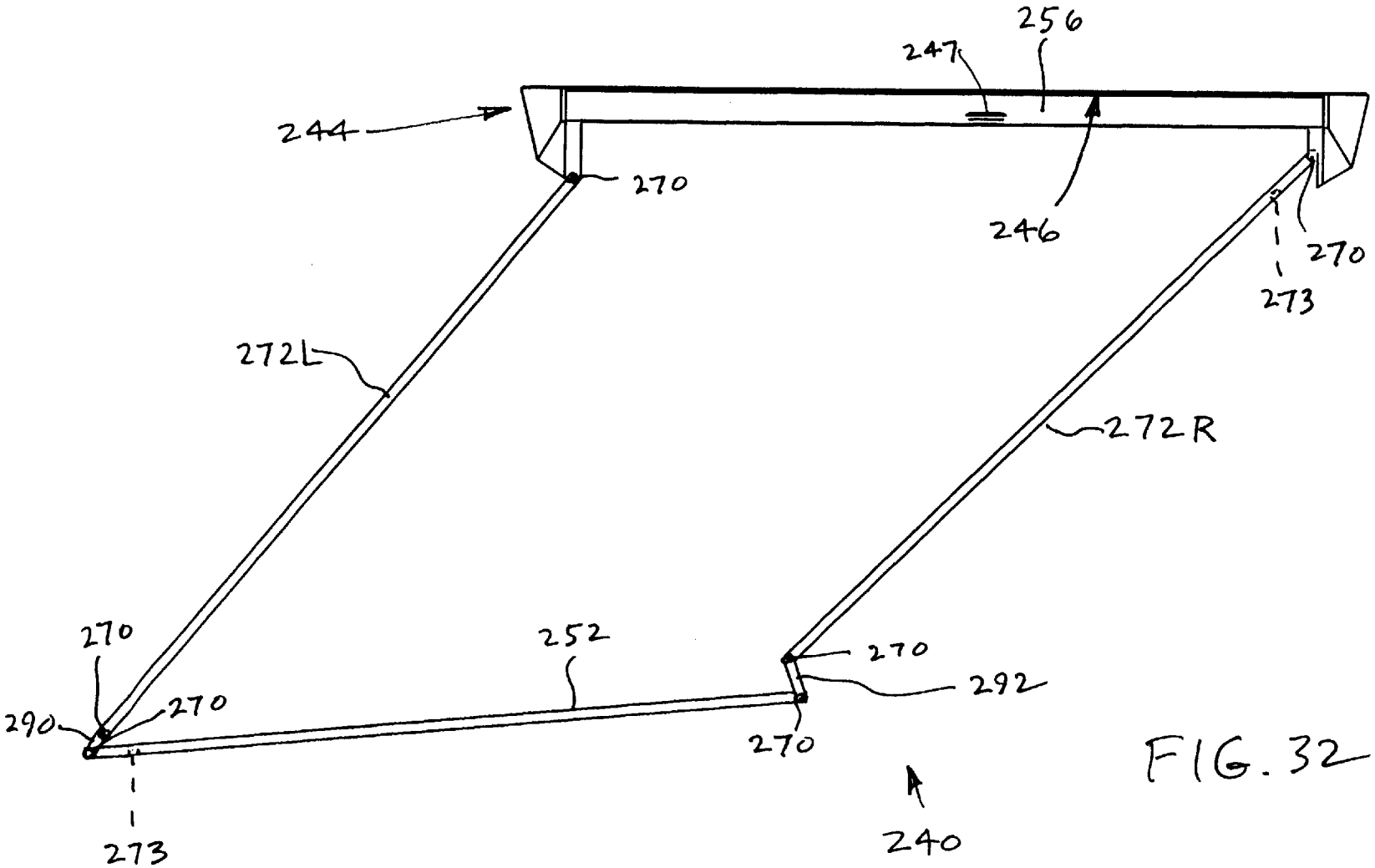
FIG. 32 illustrates a top plan view of the embodiment illustrated in FIGS. 29–31 in an early stage of deployment.

FIG. 32 illustrates a first step in the process for deploying the parcel box 240 to its fully deployed orientation in preparation for receiving (a) parcel(s). The left side panel 272 L is pulled away from the magnetic strip 273 and rotated away from the wall 246. As the left side panel 272 L extends past square in its rotation, the front 252 and right side 272 R panels are moved outward, away from the wall 246.

Figure 33:
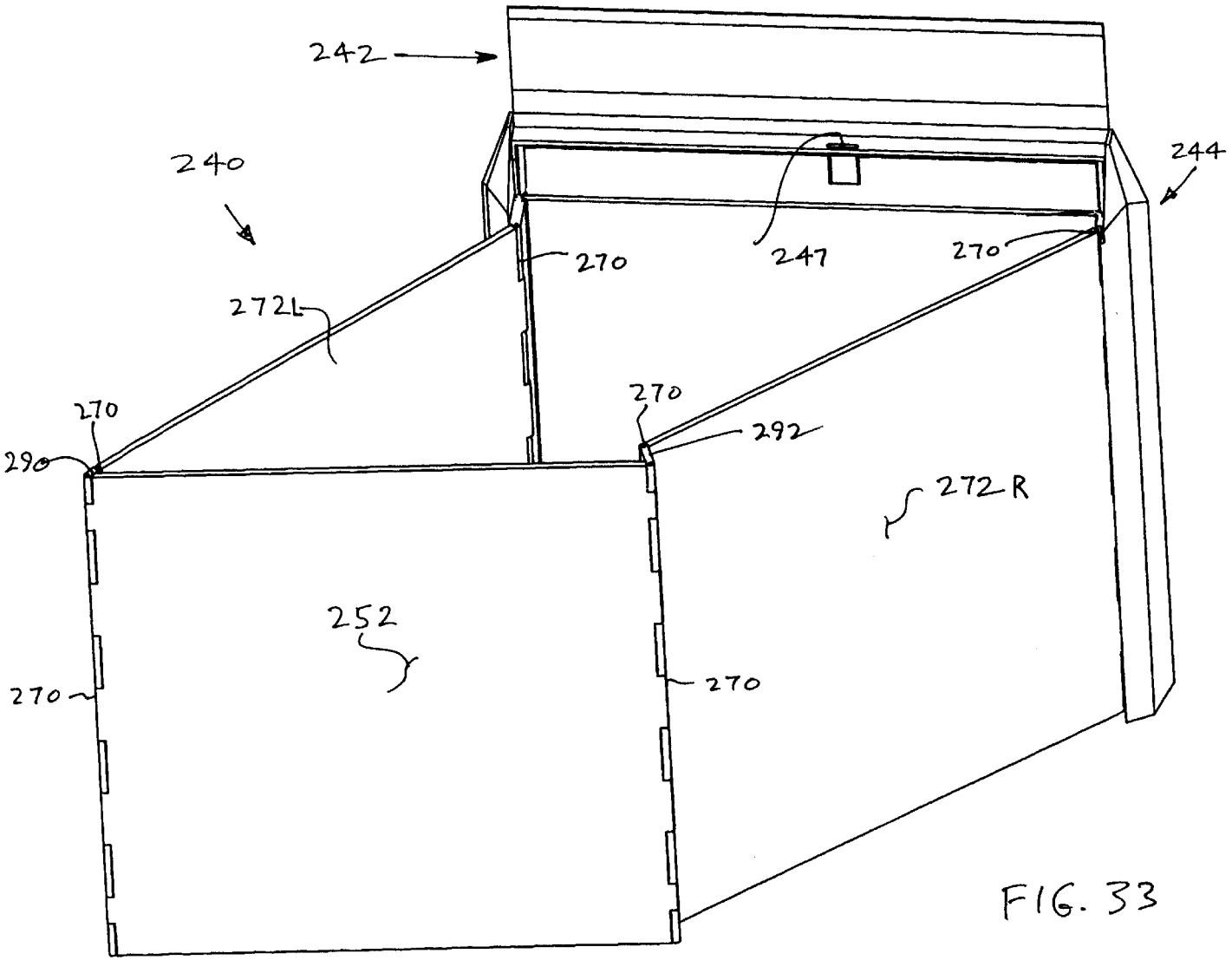
FIG. 33 illustrates a perspective view of the embodiment illustrated in FIGS. 29–32, taken from the front, right hand side and above, in a subsequent stage of deployment.

FIG. 33 illustrates a further step in the opening process of the swing out parcel receiving box 240. The double hinged cover plate 242 is rotated up toward the wall 246 and is left there, out of the way, while the side panels 272 L, 272 R and front panel 252 are swung out to form the box 240.

Figure 34:
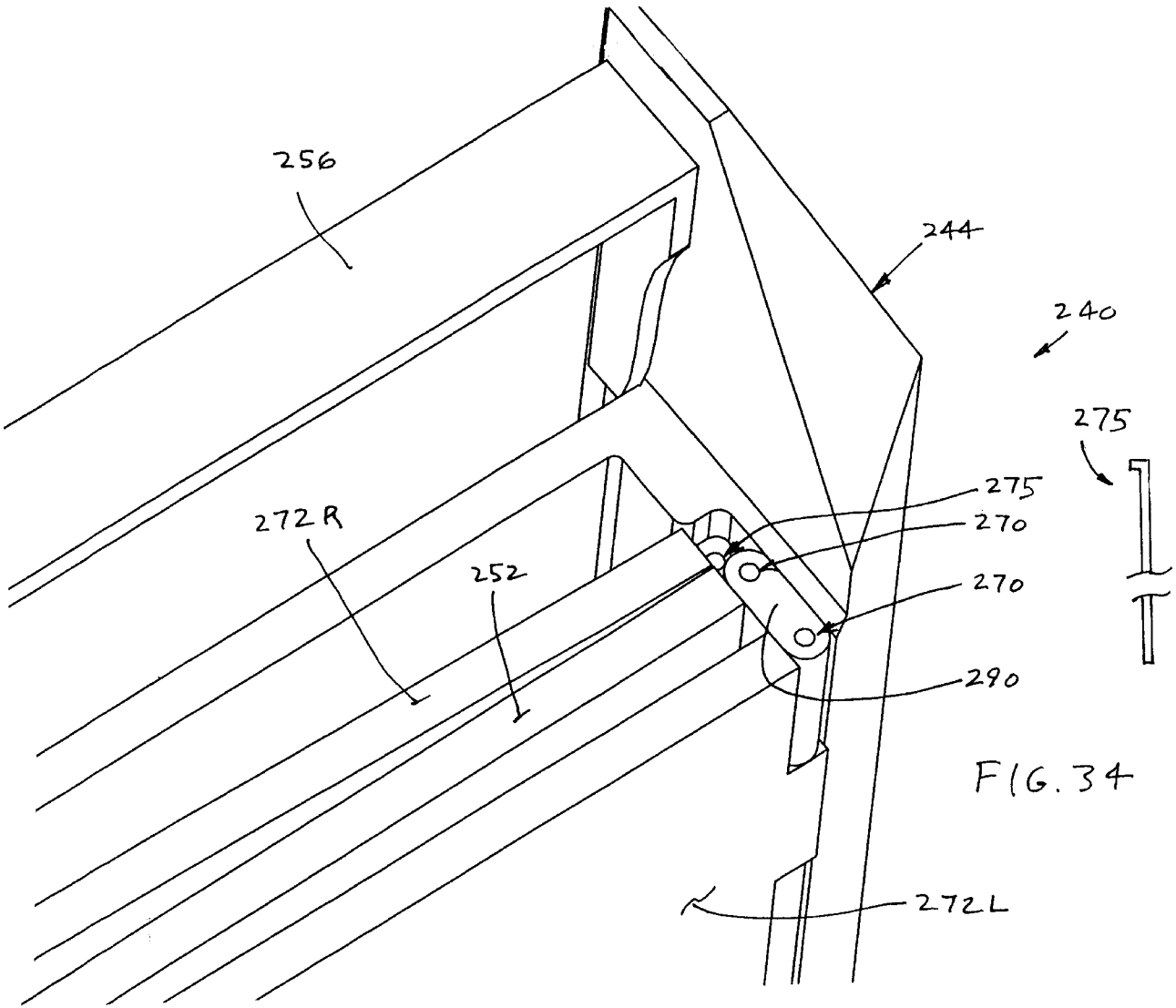
FIG. 34 illustrates an enlarged perspective view from the front, left and above, of the embodiment illustrated in FIGS. 29–33.

FIG. 34 illustrates a somewhat enlarged perspective view from the top, front left, of the undeployed swing out parcel receiving box 240. As with the previously described embodiments, the hinges 270 include pins, which may be metal or plastic rods that run the length of the doors. All pins except a removable pin 275 can be fixed in place at the time of manufacture. The removable pin 275 may have a handle formed at one end. The pin 275 is removed when the user wishes to remove (a) delivered parcel(s). An example of a pin handle configuration is illustrated.

Figure 35:
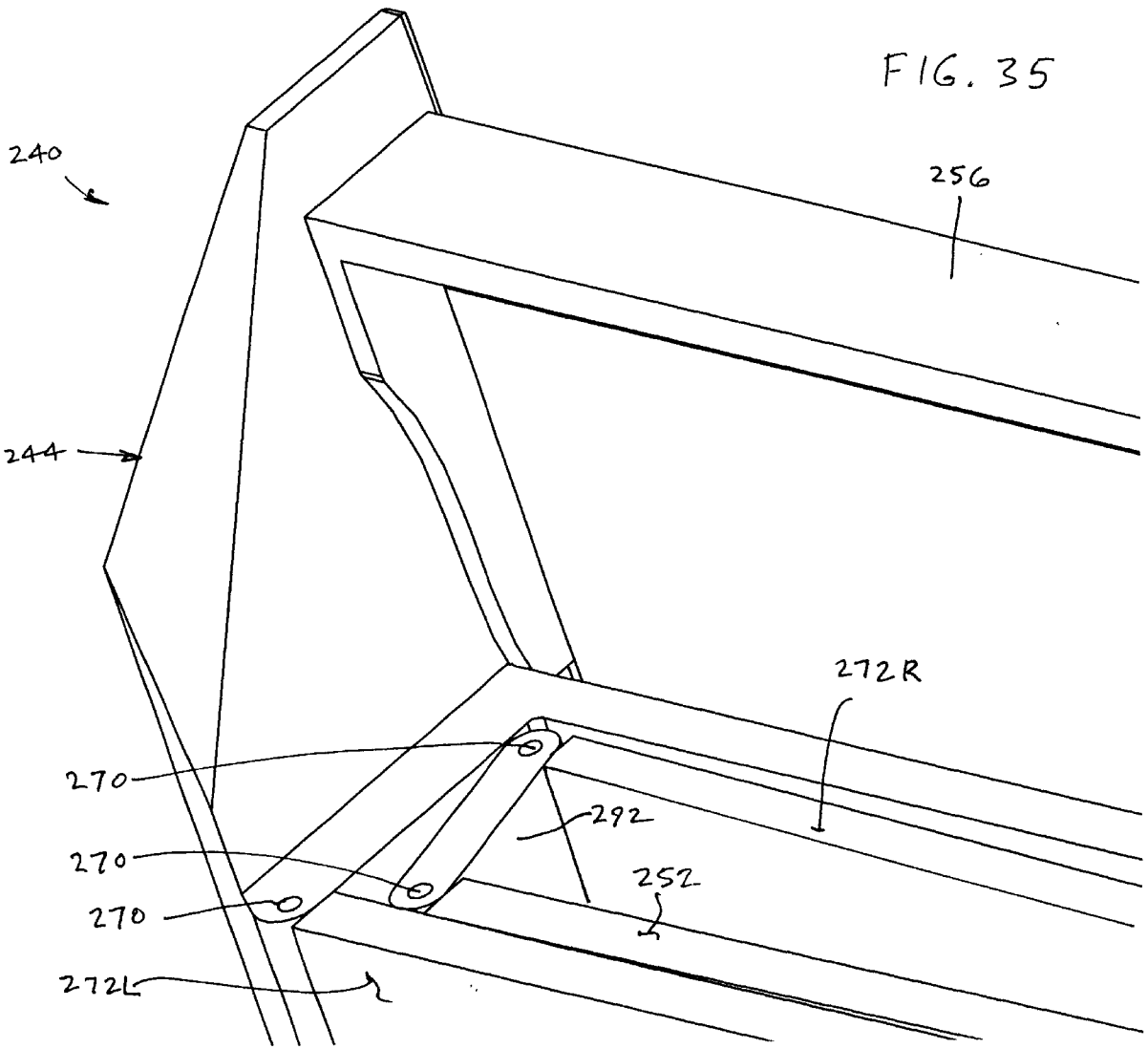
FIG. 35 illustrates an enlarged perspective view, from the front right side and above, of the embodiment illustrated in FIGS. 29–34.

FIG. 35 illustrates an enlarged perspective view, from the front right side and above, of the left side of the parcel receiving box 240 in its undeployed orientation. The top lid 256 again is illustrated in its undeployed orientation.

Figure 36:
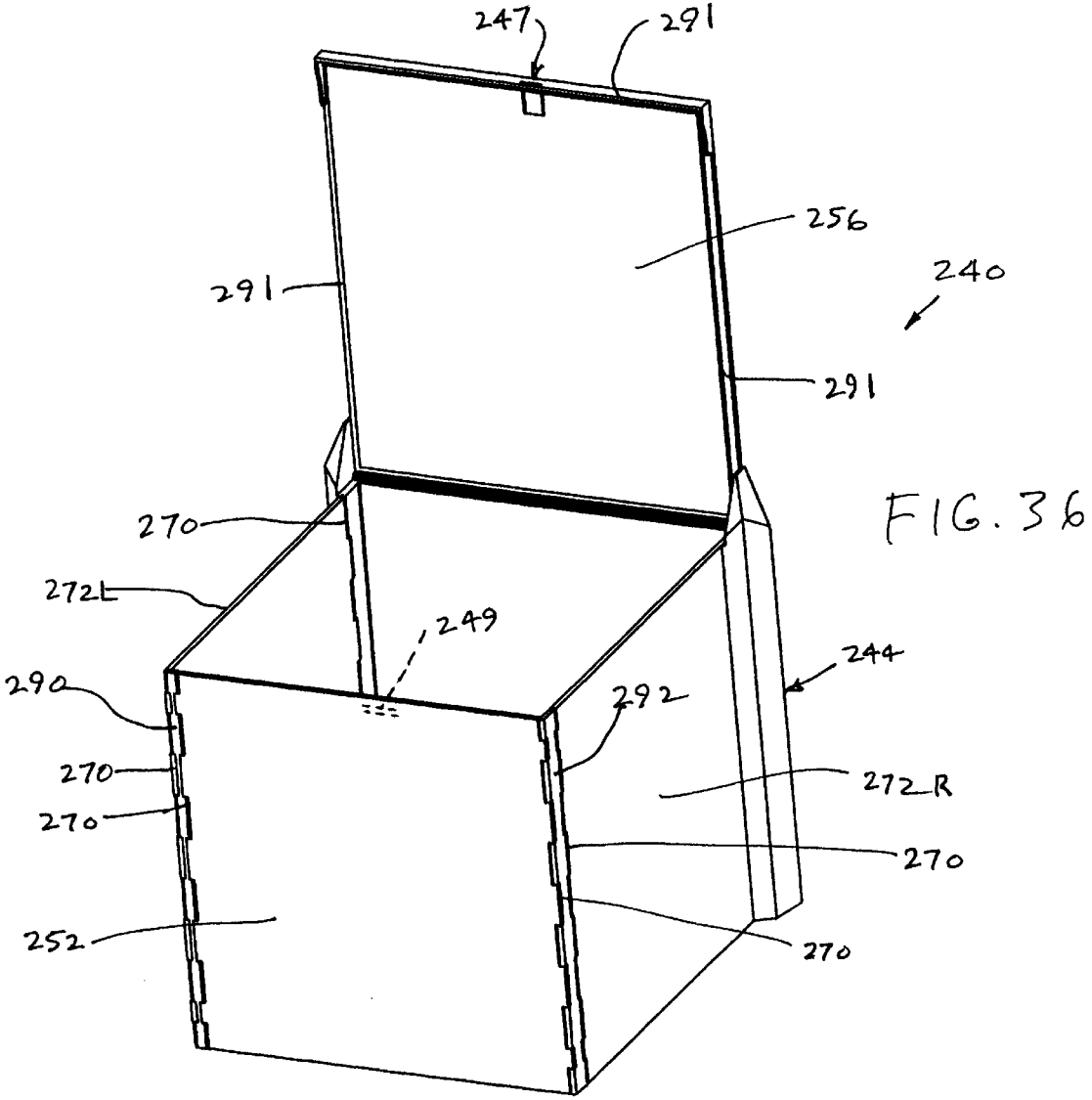
FIG. 36 illustrates a perspective view of the embodiment illustrated in FIGS. 29–35, taken from the front, right hand side and above, in a subsequent stage of deployment.

FIG. 36 illustrates the top lid 256 fully extended and ready to be lowered into position to lock the swing out parcel receiving box 240. A locking groove 291 formed around the perimeter of the top lid 256 locks the panels 272 L, 252, 272 R in their deployed orientations, thereby reducing the likelihood of unauthorized access. A lock mechanism 247 of any of a number of known types drives a bolt through a locking slot 249 provided in panel 252.

Figure 37:
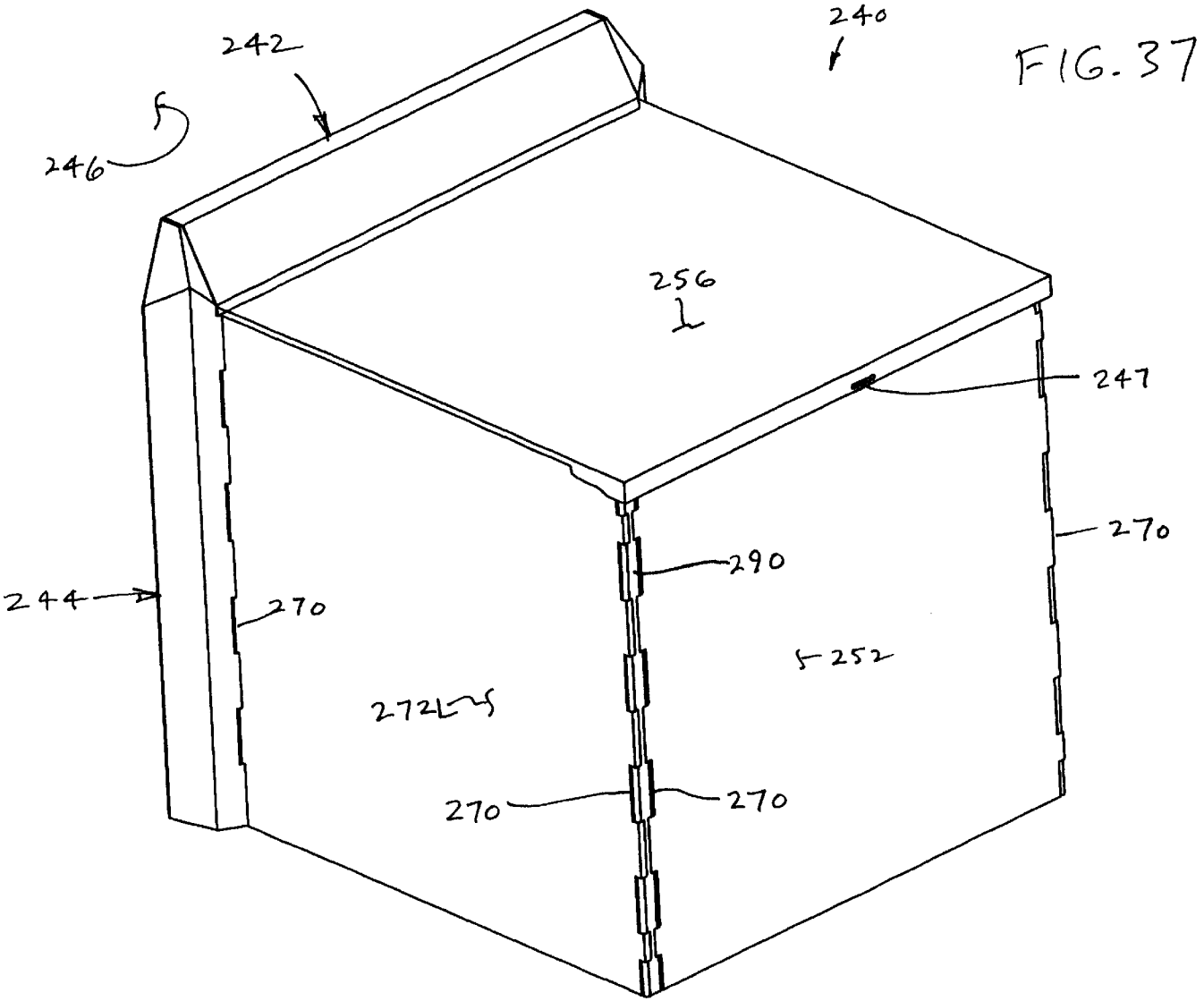
FIG. 37 illustrates a perspective view of the embodiment illustrated in FIGS. 29–36, taken from the front, left hand side and above, fully deployed.

FIG. 37 illustrates a perspective view from the front, left side and above, of the closed, fully deployed, swing out parcel receiving box 240. To retrieve the delivered parcel(s), an authorized individual uses a key to release the bolt associated with the lock 247, permitting the individual to rotate the top lid 256 upward toward the wall 246 and then permit it to drop down between the wall 246 and the wall mount structure 244. The removable pin 275 may be removed from the right side of the wall mount structure and the three panels 272 L, 252, 272 R and two link members 290, 292 rotated to facilitate removal of the parcel(s). Once the parcel(s) has (have) been removed, the panels 272 L, 252, 272 R and link members 290, 292 are rotated back towards the wall 246 and the removable pin 275 is replaced. The double hinged cover plate 254 is lowered to cover the internal components. While no secondary parcel gate 68 is illustrated in this embodiment, one clearly could be provided in the same manner as in the embodiment illustrated in FIGS. 1–24.

Figure 38:
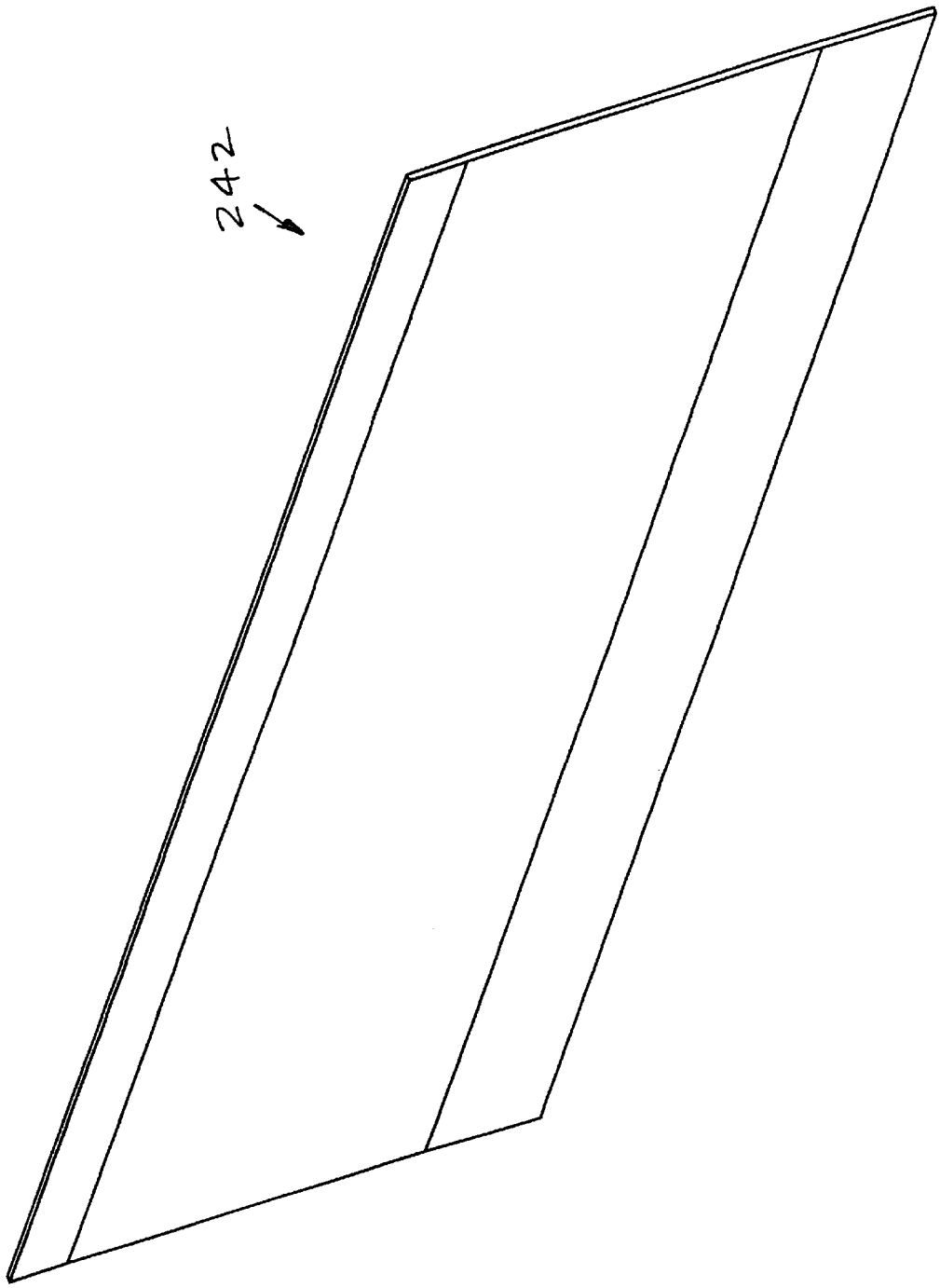
FIG. 38 illustrates a perspective view of a component of the system illustrated in FIGS. 29–37.

FIG. 38 illustrates the double hinged cover plate 242 in the open position.

Figure 39:
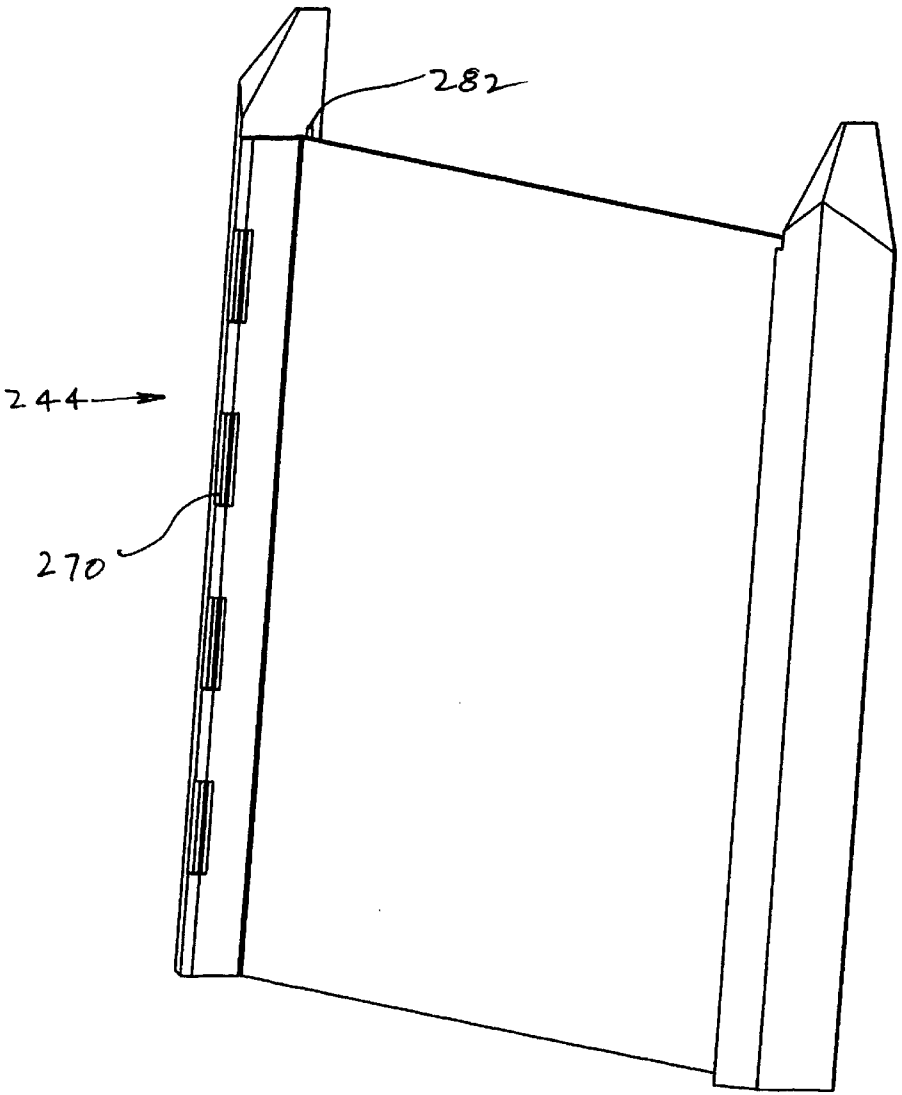
FIG. 39 illustrates a perspective view from the front, right and above, of another component of the system illustrated in FIGS. 29–37.
Figure 40:
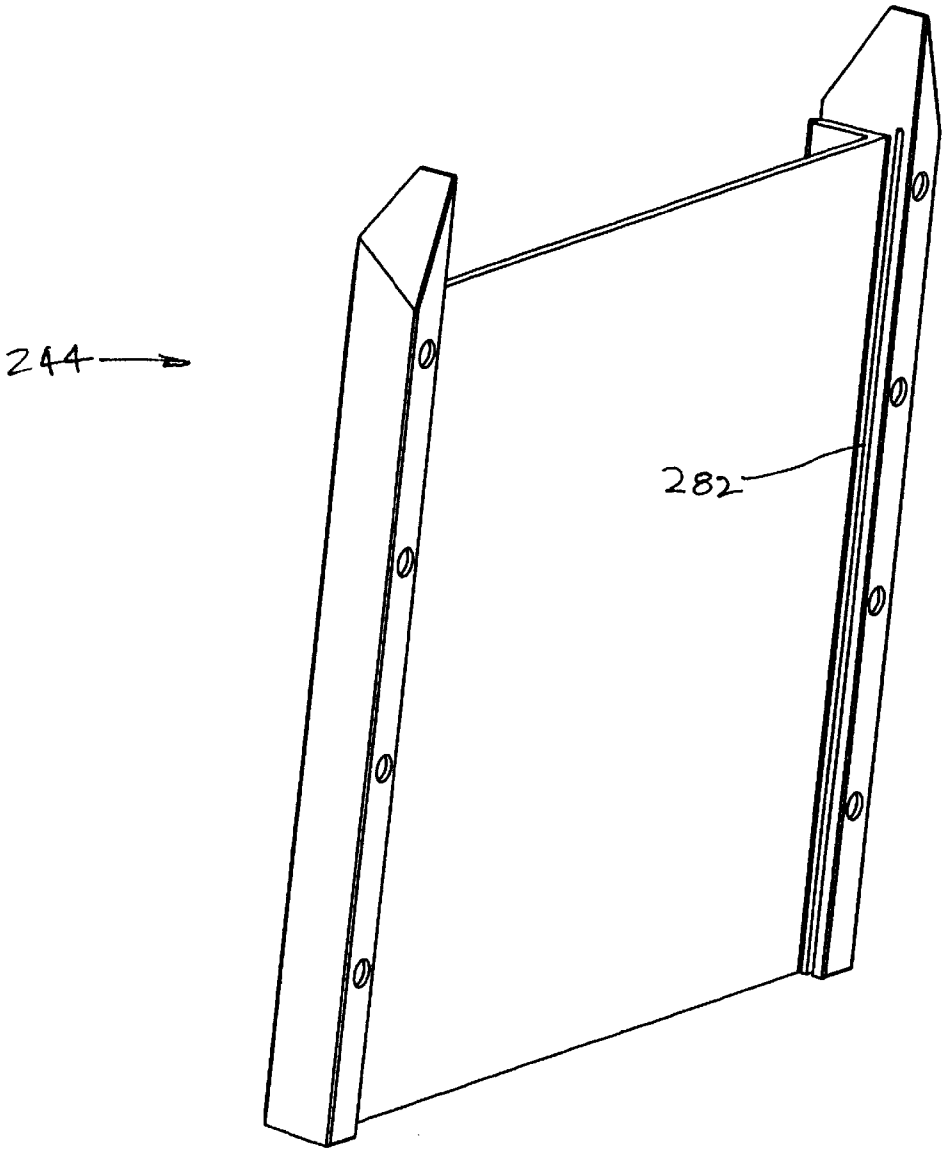
FIG. 40 illustrates a perspective view from the rear, right and above, of the component illustrated in FIG. 39.
Figure 41:
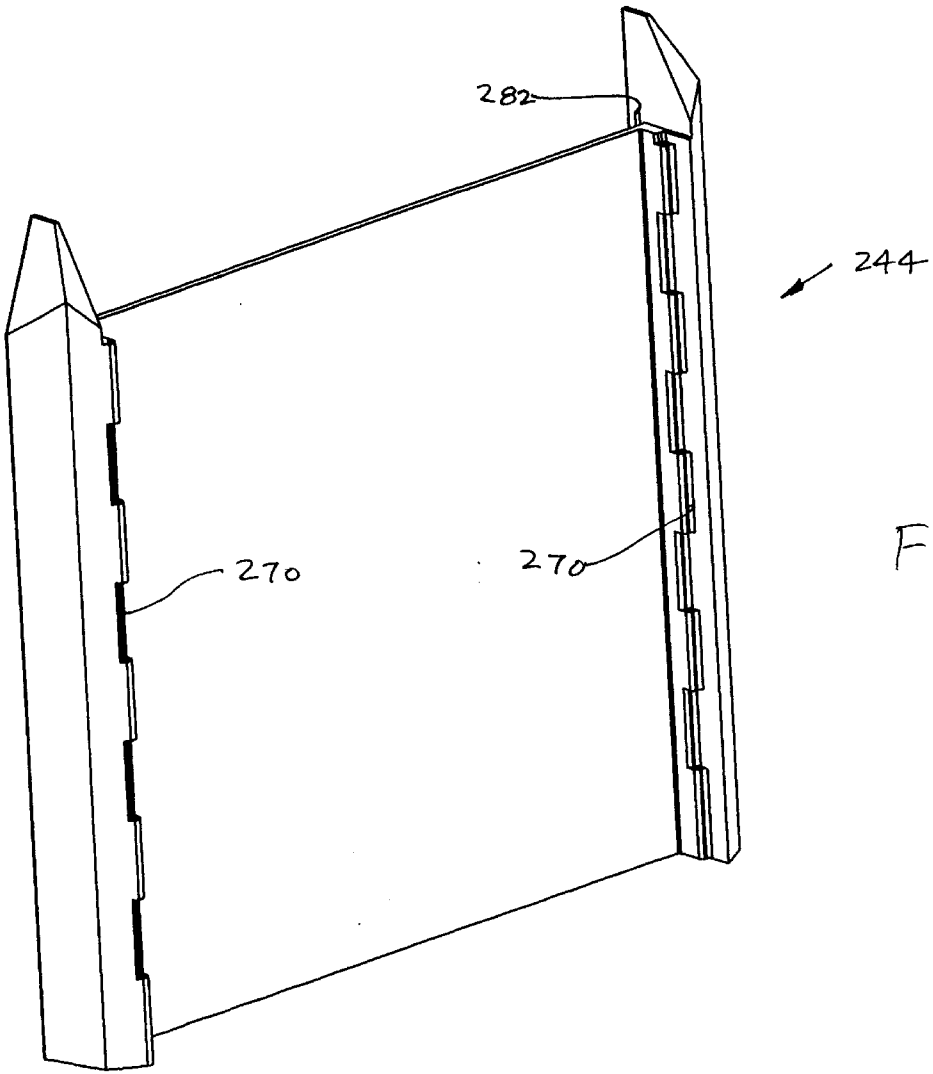
FIG. 41 illustrates a perspective view from the front, left and above, of the component illustrated in FIGS. 39–40.

FIG. 39 illustrates the wall mount structure 244. Snap on cover panels are used to cover over the bolt hole access. One of the guide slots 282 for the top lid 256 pivot pins 294 is also illustrated. FIGS. 40–41 illustrate the wall mount structure 244.

Figure 42:
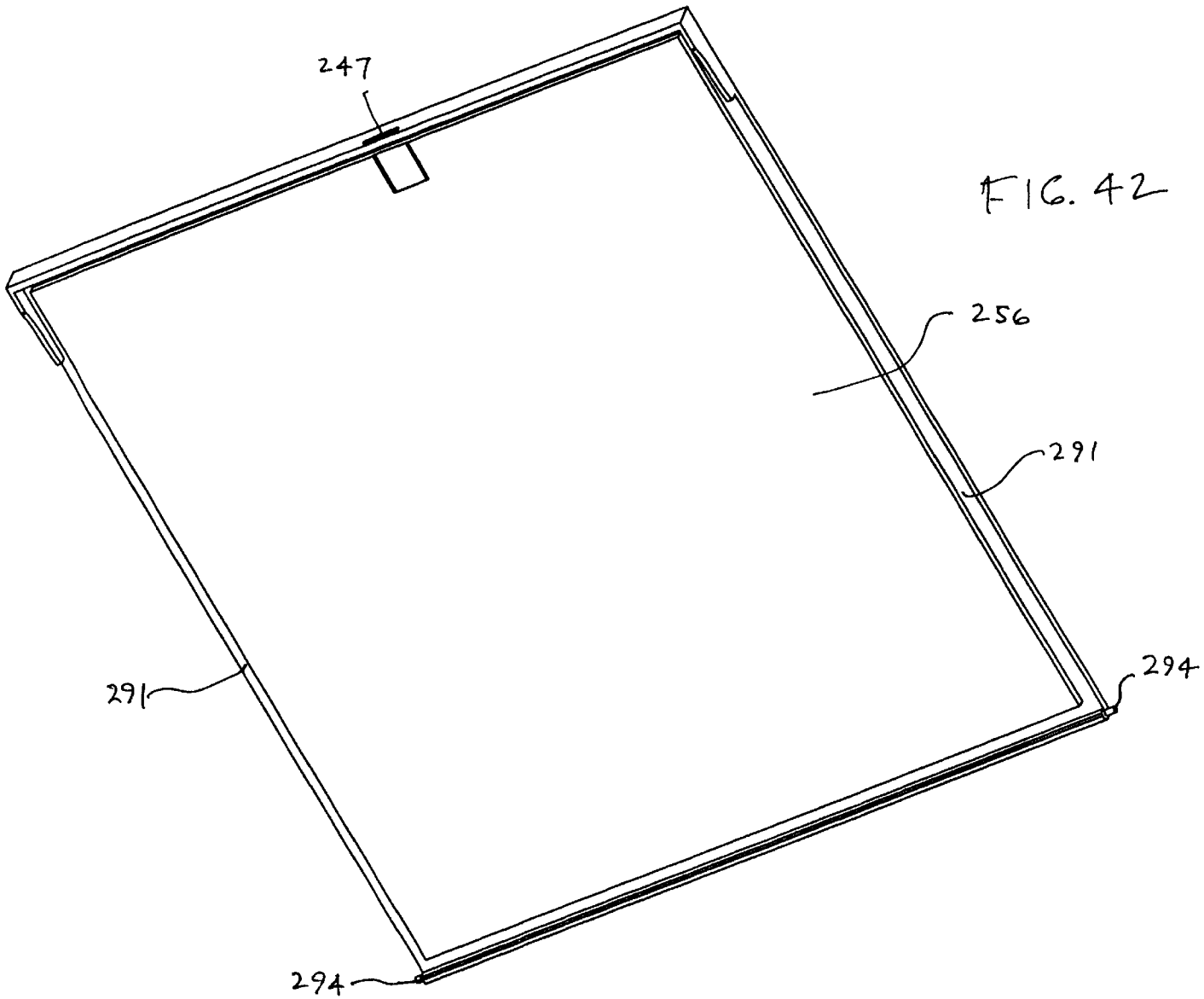
FIG. 42 illustrates a perspective view of another component of the system illustrated in FIGS. 29–37.

FIG. 42 illustrates the underside of the top lid 256. The guide slots 282 and pivot pins 294 that slide up and down in guide slots 282, and pivot in guide slots 282 to permit closing and opening of the lid 256 are illustrated.

Figure 43:
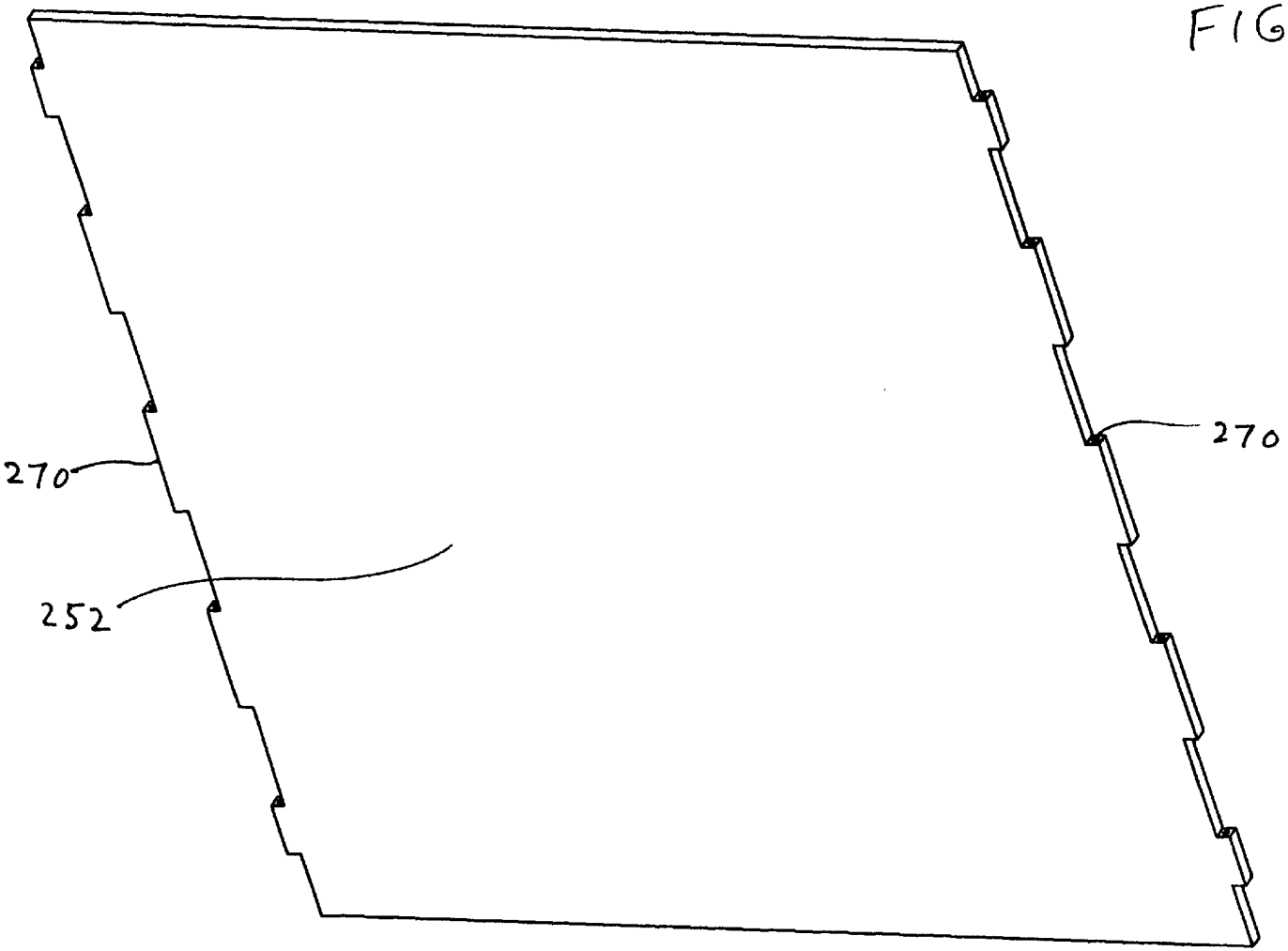
FIG. 43 illustrates a perspective view of another component of the system illustrated in FIGS. 29–37.

FIG. 43 illustrates the front panel 252.

Figure 44:
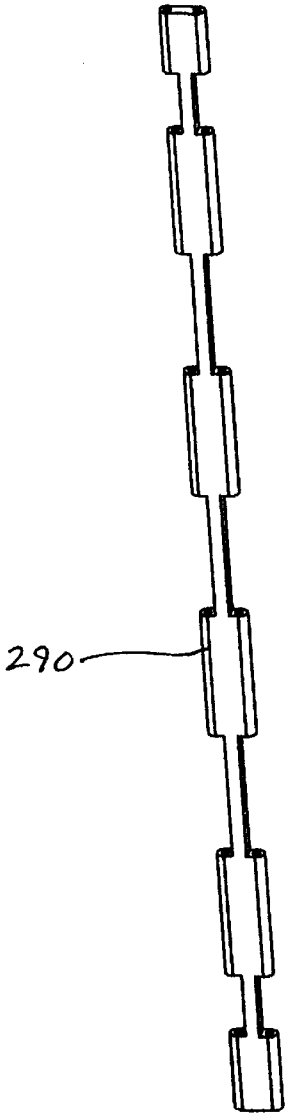
FIG. 44 illustrates a perspective view of another component of the system illustrated in FIGS. 29–37.

FIG. 44 illustrates the small link 290 that links the left side panel 272 L and the front panel 252.

Figure 45:
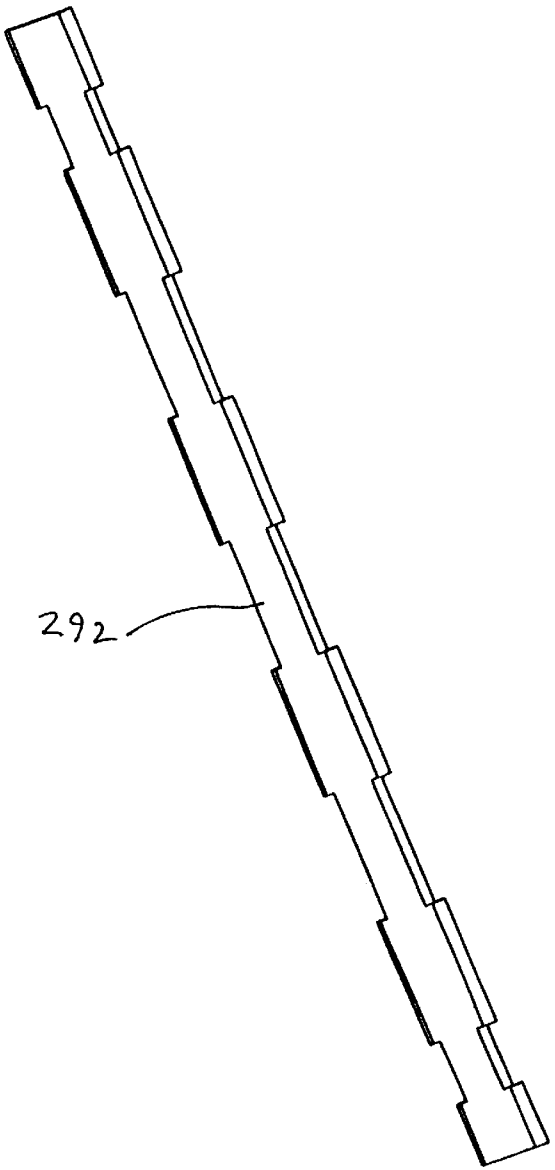
FIG. 45 illustrates a perspective view of another component of the system illustrated in FIGS. 29–37.

FIG. 45 illustrates the large link 292 that links the front panel 252 and the right side panel 272 R.

Figure 46:
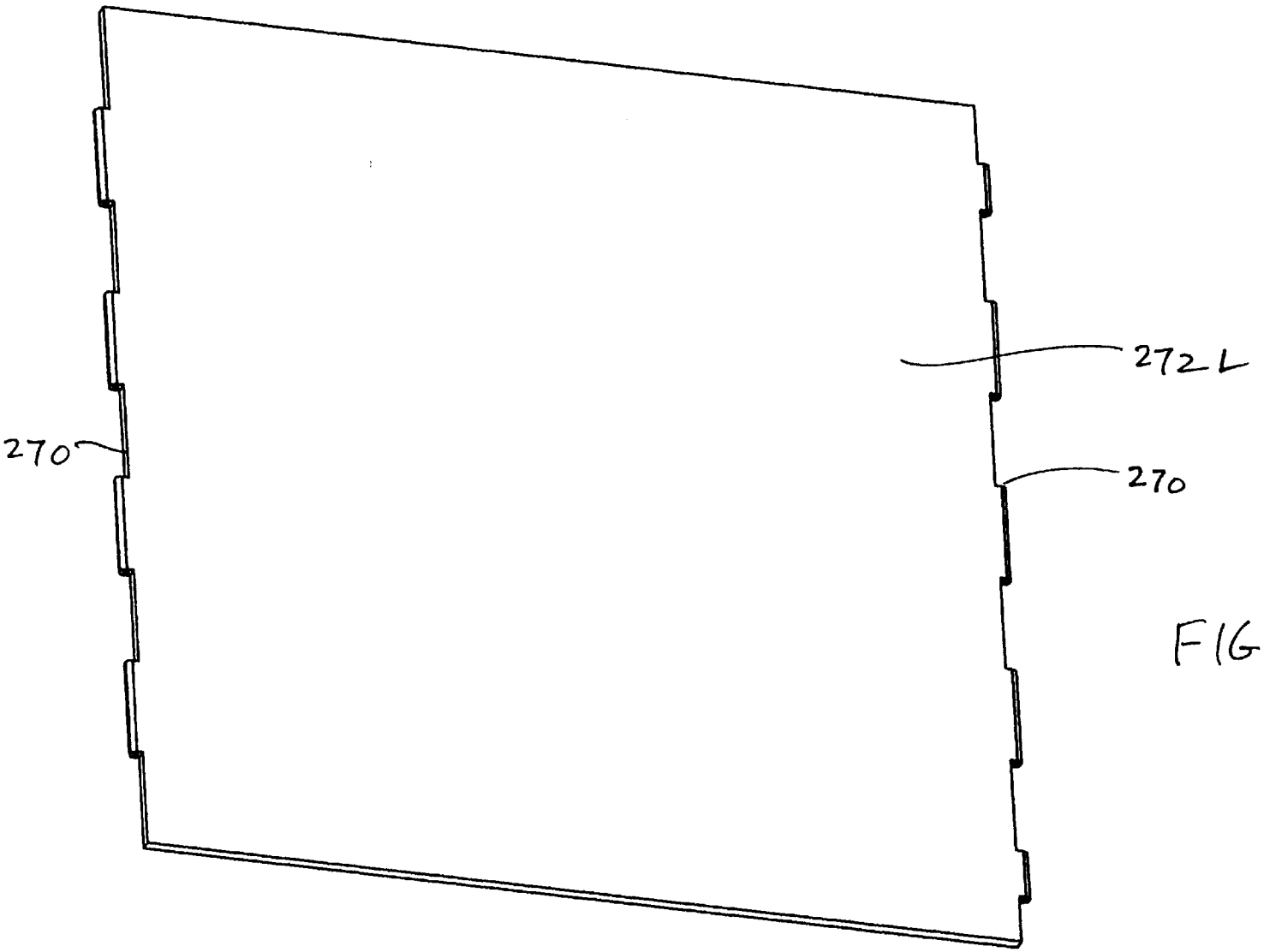
FIG. 46 illustrates a perspective view of another component of the system illustrated in FIGS. 29–37; and, FIG. 47 illustrates a perspective view of another component of the system illustrated in FIGS. 29–37.
Figure 47:
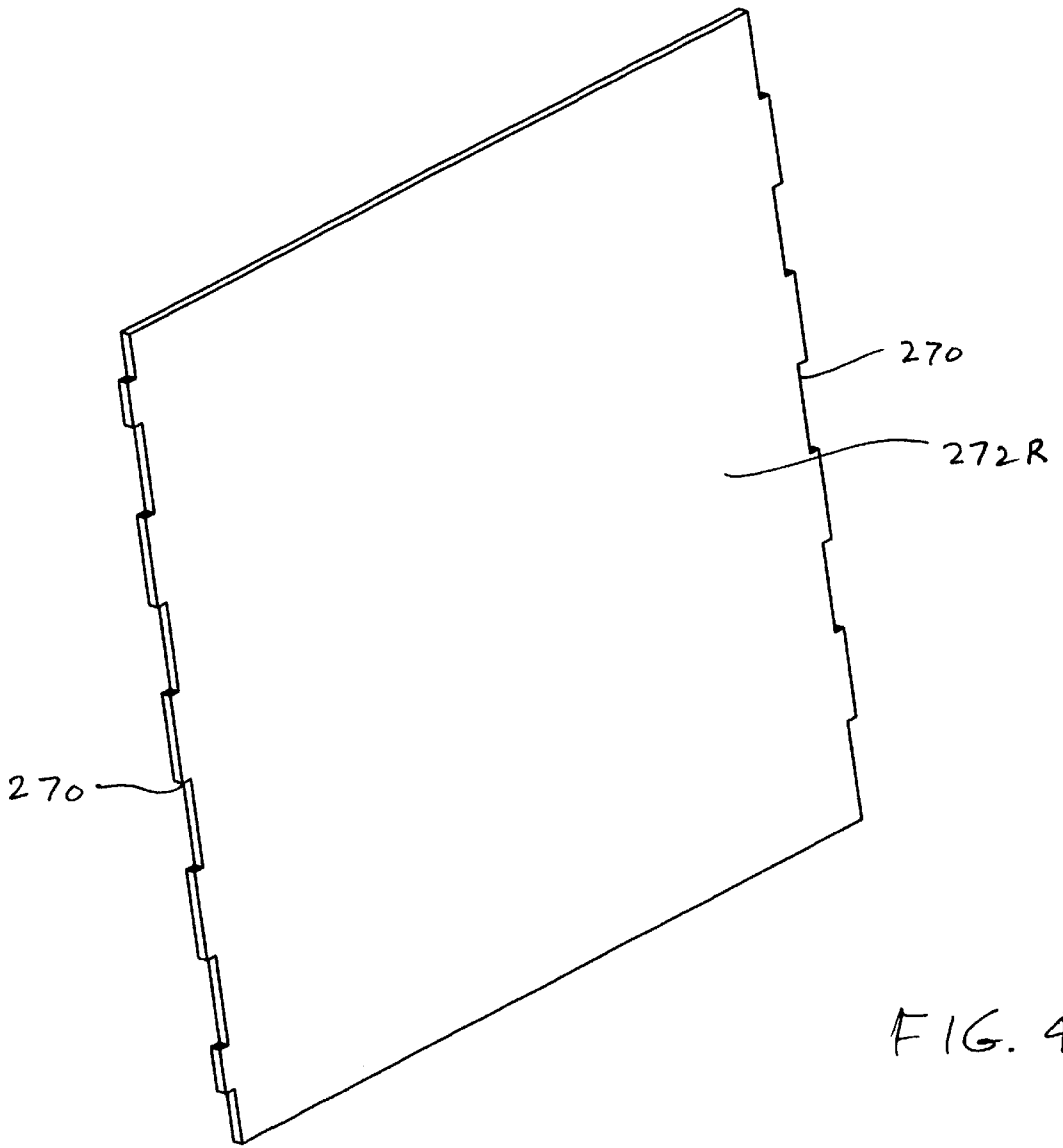

FIG. 46 illustrates the left side panel 272 L. FIG. 47 illustrates the right side panel 272 R.

What is claimed is:

1. An enclosure including two panel mounts for orienting adjacent a surface, two side panels movable between side panel storage orientations generally between the panel mounts and side panel use orientations in which the side panels project away from the surface generally perpendicular to the surface, a top panel having a top panel storage orientation generally between the panel mounts and a top panel use orientation in which the top panel is projected from between the panel mounts and pivoted downwardly and forwardly to overlie and engage the side panels, and a front panel for engagement with the side panels and the top panel when the top panel is in said top panel use orientation to form an enclosure, and links for coupling the side panels and the front panel together, each side panel being pivotally coupled to a respective panel mount by hinges and projecting forwardly from the respective panel mount in said side panel use orientation and being pivotally coupled to a respective link, and each link being pivotally coupled to the front panel.

2. The enclosure of claim 1 wherein when the top panel is in the top panel use orientation the top panel is projected upward from between the panel mounts and pivoted downwardly and forwardly to overlie and engage the side panels.

3. The enclosure of claim 1 wherein the top panel includes a first top component and a second top component.

4. The enclosure of claim 1 further including a mechanism by which the enclosure can be locked when the panels are so oriented as to form the enclosure.

5. A method for providing an enclosure including providing two panel mounts for orienting adjacent a surface, movably coupling a side panel to each panel mount for movement of the side panels between side panel storage orientations generally between the panel mounts and side panel use orientations in which the side panels project away from the surface generally perpendicular to the surface, mounting a top panel for movement between a top panel storage orientation generally between the panel mounts and a top panel use orientation overlying and engaging the side panels, and providing a front panel for engaging the side panels and the top panel when the top panel is in said top panel use orientation to form an enclosure, coupling the side panels and the front panel together through links, each side panel being pivotally coupled to a respective panel mount by hinges and projecting forwardly from the respective panel mount in said side panel use orientation and being pivotally coupled to a respective link, and each link being pivotally coupled to the front panel.

6. The method of claim 5 including projecting the top panel upward from between the panel mounts and pivoting the top panel downwardly and forwardly to overlie and engage the side panels.

7. The method of claim 5 wherein providing the top panel includes providing a first top component and a second top component.

8. The method of claim 5 further including providing a mechanism by which the enclosure can be locked when the panels are so oriented as to form the enclosure.

* * * * *